US005403501A

United States Patent [19]

Schwind

[11] Patent Number: 5,403,501

[45] Date of Patent: Apr. 4, 1995

[54] UNIVERSAL DRIVELINE FLUID

[75] Inventor: James J. Schwind, Eastlake, Ohio

[73] Assignee: The Lubrizol Corporation, Wickliffe, Ohio

[21] Appl. No.: 261,798

[22] Filed: Jun. 20, 1994

Related U.S. Application Data

[63] Continuation of Ser. No. 136,628, Oct. 14, 1993, abandoned, which is a continuation of Ser. No. 461,185, Jan. 5, 1990, abandoned.

[51] Int. Cl.[6] ..... C10M 137/08; C10M 137/00

[52] U.S. Cl. ..... 252/32.7 E; 252/49.006; 252/45

[58] Field of Search ..... 252/32.7 E, 49.6, 45, 252/38

[56] References Cited

U.S. PATENT DOCUMENTS

| | | | |
|---|---|---|---|
| 3,480,548 | 11/1969 | Hellmuth et al. | 252/33.4 |
| 3,929,650 | 12/1975 | King et al. | 252/33.4 |
| 4,119,549 | 10/1978 | Davis | 252/45 |
| 4,119,550 | 10/1978 | Davis et al. | 252/45 |
| 4,147,640 | 4/1979 | Jayne et al. | 252/45 |
| 4,188,297 | 2/1980 | Jayne et al. | 252/45 |
| 4,191,659 | 3/1980 | Davis | 252/45 |
| 4,282,171 | 8/1981 | Hoke | 260/928 |
| 4,344,854 | 8/1982 | Davis et al. | 252/45 |
| 4,505,830 | 3/1985 | Vinci | 252/33 |
| 4,560,488 | 12/1985 | Vinci | 252/38 |
| 4,582,618 | 4/1986 | Davis | 252/32.7 |
| 4,654,156 | 3/1987 | Horodysky et al. | 252/47 |
| 4,661,274 | 4/1987 | Horodysky et al. | 252/47 |
| 4,670,169 | 6/1987 | Adams et al. | 252/46.7 |
| 4,744,920 | 5/1988 | Fischer et al. | 252/33.4 |
| 4,752,416 | 6/1988 | Scharf et al. | 252/78.5 |
| 4,755,311 | 7/1988 | Burjes et al. | 252/49.9 |
| 4,770,801 | 9/1988 | Adams et al. | 252/46.7 |
| 4,786,425 | 11/1988 | Horodysky et al. | 252/47 |
| 4,792,410 | 12/1988 | Schwind et al. | 252/38 |

FOREIGN PATENT DOCUMENTS

| | | |
|---|---|---|
| 1347845 | 2/1974 | United Kingdom . |
| 8707638 | 12/1987 | WIPO . |
| 8803144 | 5/1988 | WIPO . |
| 8804685 | 6/1988 | WIPO . |
| 8805810 | 8/1988 | WIPO . |
| 8906682 | 7/1989 | WIPO . |
| 8906683 | 7/1989 | WIPO . |
| 8909811 | 10/1989 | WIPO . |

OTHER PUBLICATIONS

Hackh's Chemical Dictionary, 3rd edition, Julius Grant, Ed., McGraw-Hill Book Co., N.Y., p. 333.

*Primary Examiner*—Jacqueline V. Howard
*Attorney, Agent, or Firm*—Frederick D. Hunter; John H. Engelmann; James A. Cairns

[57] ABSTRACT

This invention relates to lubricating compositions comprising:

(A) a major amount of an oil of lubricating viscosity;

(B) at least one borated overbased Group I or II metal salt of an organic acid;

(C) at least one polysulfide-containing organic composition; and (D) at least one phosphorus-containing composition other than a zinc dithiophosphate.

Lubricating compositions of the present invention have beneficial viscosity and friction characteristics required by a manual transmission as well as beneficial extreme pressure protection required for a gear assembly.

67 Claims, No Drawings

UNIVERSAL DRIVELINE FLUID

This is a continuation of application Ser. No. 08/136,628, filed on Oct. 14, 1993, which is a Continuation of Ser. No. 07/461,185, filed on Jan. 5, 1990, both now abandoned.

FIELD OF THE INVENTION

This invention relates to lubricating compositions for manual transmissions and gear assemblies.

BACKGROUND OF THE INVENTION

Universal driveline fluids are used to lubricate manual transmissions as well as final drive gear assemblies.

In manual transmissions, the choice of materials making up the synchronizer can influence performance. However, the lubricating fluid also plays a critical role. Manual transmission fluids require frictional retention properties to avoid a phenomenon known as synchronizer clashing (sometimes referred to as crashing). Clashing of the synchronizer results when the dynamic coefficient of friction building between the engaging synchronizer parts (plate to plate or ring to cone) falls below a critical minimum value. Below this critical minimum value the synchronizer parts do not attain zero relative velocity and the lockup mechanism (e.g., spline camphers) contacts the rotating member (e.g., cone camphers) resulting in a loud noise (clashing/-crashing).

Final drive gear assemblies generally employed today are a hypoid gear arrangement. The hypoid gear involves extensive sliding motion. The sliding motion squeezes out the lubricant between the gears resulting in boundary lubricating conditions. In boundary lubrication conditions, lubrication occurs between two rubbing surfaces without the development of a full-fluid lubricating film. These conditions contrast to hydrodynamic lubrication conditions where a full-fluid lubricating film is maintained between the surfaces. A lubricant must provide effective extreme pressure and antiwear protection under boundary lubrication conditions. This is particularly important in an area where the final drive gear assembly is operated under low speed-high torque conditions or is subjected to high speed and shock loading conditions.

Generally when a lubricant is formulated to solve the requirements of a manual transmission, it lacks the necessary extreme pressure protection for hypoid gears. When a lubricant is formulated for a final drive gear assembly, it often lacks the friction properties necessary for a manual transmission.

U.S. Pat. No. 4,792,410 issued to Schwind et al relates to lubricant compositions suitable for manual transmission fluids.

U.S. Pat. No. 4,744,920 issued to Fischer et al relates to carbonated overbased products which are borated and processes for making the same.

U.S. Pat. No. 3,929,650 issued to King et al discloses borated overbased alkali metal carbonates of metal sulfonates.

U.S. Pat. No. 3,480,548 issued to Hellmuth et al discloses overbased boronated products.

U.S. Pat. No. 3,679,584 issued to Hellmuth relates to overbased alkaline earth metal sulfonates reacted with boric acid.

U.S. Patents 4,119,549 and 4,191,659 issued to Davis and U.S. Pat. Nos. 4,119,550 and 4,344,854 issued to Davis et al relate to sulfurized compositions prepared by the reaction of olefin compounds with a mixture of sulfur and hydrogen sulfide.

SUMMARY OF THE INVENTION

This invention relates to lubricating compositions comprising:

(A) a major amount of an oil of lubricating viscosity;

(B) at least one borated overbased Group I or II metal salt of an organic acid;

(C) at least one polysulfide-containing organic composition; and (D) at least one phosphorus-containing composition other than a zinc dithiophosphate.

Lubricating compositions of the present invention have beneficial viscosity and friction characteristics required by a manual transmission as well as beneficial extreme pressure protection required for a final drive gear assembly.

DESCRIPTION OF THE PREFERRED EMBODIMENTS

This invention relates to lubricating compositions which contain additives that provide the sliding friction as well as the extreme pressure protection for manual transmissions as well as final drive gear assemblies. Further, these lubricating compositions meet the API GL5 requirements.

Component A

The lubricating compositions and methods of this invention employ an oil of lubricating viscosity, including natural or synthetic lubricating oils and mixtures thereof. Natural oils include animal oils, vegetable oils, mineral lubricating oils, solvent or acid treated mineral oils, and oils derived from coal or shale. Synthetic lubricating oils include hydrocarbon oils, halo-substituted hydrocarbon oils, alkylene oxide polymers, esters of dicarboxylic acids and polyols, esters of phosphorus-containing acids, polymeric tetrahydrofurans and silicon-based oils.

Unrefined, refined and rerefined oils, either natural or synthetic may be used in the compositions of the present invention.

Specific examples of the oils of lubricating viscosity are described in U.S. Pat. No. 4,326,972 and European Patent Publication 107,282, both herein incorporated by reference for their disclosures relating to lubricating oils. A basic, brief description of lubricant base oils appears in an article by D. V. Brock, "Lubricant Engineering", volume 43, pages 184–185, March, 1987. This article is herein incorporated by reference for its disclosures relating to lubricating oils.

A description of oils of lubricating viscosity occurs in U.S. Pat. No. 4,582,618 (column 2, line 37 through column 3, line 63, inclusive), herein incorporated by reference for its disclosure to oils of lubricating viscosity.

The oil of lubricating viscosity is selected to provide lubricating compositions of at least SAE 60 grade. Preferably, the lubricating compositions have a grade of SAE 65, more preferably SAE 75. The lubricating composition may also have a so-called multigrade rating such as SAE 60W-80, preferably 65W-80 or 65W-90, more preferably 75W-80 or 75W-90, more preferably 75W-90. Multigrade lubricants include a viscosity improver which is formulated with the oil of lubricating viscosity to provide the above lubricant grades. Useful viscosity improvers include polyolefins, such as polybutylene; rubbers, such as styrene-butadiene or styreneisoprene; or polyacrylates, such as polymethacrylates. Preferably the viscosity improver is a polyolefin or polymethacrylate, more preferably polymethacrylate. Viscosity improvers available commercially include Acryloid TM viscosity improvers available from Rohm & Haas; Shellvis TM rubbers available from Shell Chemical; and Lubrizol 3174 available from The Lubrizol Corporation.

Component B

Component B is a borated, overbased Group I or II (Chemical Abstracts Service (CAS) version of the Periodic Table of the Elements) metal salt of an organic acid. The borated overbased materials are characterized by metal content in excess of that which would be present according to the stoichiometry of the metal and organic acid reactant. The amount of excess metal is commonly reported in metal ratio. The term "metal ratio" is the ratio of the equivalents of metal base to the equivalents of the organic acid substrate. A neutral salt has a metal ratio of one. Overbased materials may have metal ratios from 1.1 to about 40 or more.

In the present invention, the borated overbased materials have metal ratios from about 1.1 to about 25, with metal ratios of from about 1.5 to about 20 being preferred, and with metal ratios of from 5 to 20 being more preferred.

Generally, overbased materials useful in the present invention are prepared by treating a reaction mixture comprising an organic acid, a reaction medium comprising at least one solvent, a stoichiometric excess of a basic metal compound and a promoter with an acidic material, typically carbon dioxide.

Organic Acids

The organic acids useful in making the borated overbased compositions of the present invention include carboxylic acid, sulfonic acid, phosphorus-containing acid, phenol or mixtures of two or more thereof.

Carboxylic Acids

The carboxylic acids useful in making the borated salts (B) of the invention may be aliphatic or aromatic, mono- or polycarboxylic acid or acid-producing compounds. These carboxylic acids include lower molecular weight carboxylic acids (e.g., carboxylic acids having up to about 22 carbon atoms such as acids having about 4 to about 22 carbon atoms or tetrapropenyl-substituted succinic anhydride) as well as higher molecular weight carboxylic acids. Throughout this specification and in the appended claims, any reference to carboxylic acids is intended to include the acid-producing derivatives thereof such as anhydrides, lower alkyl esters-, acyl halides, lactones and mixtures thereof unless otherwise specifically stated.

The carboxylic acids of this invention are preferably oil-soluble and the number of carbon atoms present in the acid is important in contributing to the desired solubility of the borated salts (B). Usually, in order to provide the desired oil-solubility, the number of carbon atoms in the carboxylic acid should be at least about 8, more preferably at least about 18, more preferably at least about 30, more preferably at least about 50. Generally, these carboxylic acids do not contain more than about 400 carbon atoms per molecule.

The lower molecular weight monocarboxylic acids contemplated for use in this invention include saturated and unsaturated acids. Examples of such useful acids include dodecanoic acid, decanoic acid, oleic acid, stearic acid, linoleic acid, tall oil acid, etc. Mixtures of two or more such agents can also be used. An extensive discussion of these acids is found in Kirk-Othmer "Encyclopedia of Chemical Technology" Third Edition, 1978, John Wiley & Sons New York, pp. 814–871; these pages being incorporated herein by reference.

Examples of lower molecular weight polycarboxylic acids include dicarboxylic acids and derivatives such as sebacic acid, cetyl malonic acid, tetrapropylene-substituted succinic anhydride, etc. Lower alkyl esters of these acids can also be used.

The monocarboxylic acids include isoaliphatic acids. Such acids often contain a principal chain having from about 14 to about 20 saturated, aliphatic carbon atoms and at least one but usually no more than about four pendant acyclic lower alkyl groups. Specific examples of such isoaliphatic acids include 10-methyltetradecanoic acid, 3-ethyl-hexadecanoic acid, and 8-methyl-octadecanoic acid.

The isoaliphatic acids include mixtures of branch-chain acids prepared by the isomerization of commercial fatty acids (oleic, linoleic or tall oil acids) of, for example, about 16 to about 20 carbon atoms.

The higher molecular weight mono- and polycarboxylic acids suitable for use in making the borated salts (B) are well known in the art and have been described in detail, for example, in the following U.S., British and Canadian patents: U.S. Pat. Nos. 3,024,237; 3,172,892; 3,219,666; 3,245,910; 3,271,310; 3,2772,746; 3,278,550; 3,306,907; 3,312,619; 3,341,542; 3,367,943; 3,374,174; 3,381,022; 3,454,607; 3,470,098; 3,630,902; 3,755,169; 3,912,764; and 4,368,133; British Patents 944,136; 1,085,903; 1,162,436; and 1,440,219; and Canadian Patent 956,397. These patents are incorporated herein by reference for their disclosure of higher molecular weight mono- and polycarboxylic acids and methods for making the same.

A group of useful aromatic carboxylic acids are those of the formula

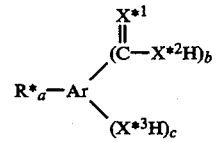

(XIII)

wherein Formula XIII, $R^*$ is an aliphatic hydrocarbyl group of preferably about 4 to about 400 carbon atoms, a is a number in the range of zero to about 4, Ar is an aromatic group, $X^{*1}$, $X^{*2}$ and $X^{*3}$ are independently sulfur or oxygen, b is a number in the range of from 1 to about 4, c is a number in the range of 1 to about 4, usually 1 to 2, with the proviso that the sum of a, b and c does not exceed the number of valences of Ar. Preferably, $R^*$ and a are such that there is an average of at least about 8 aliphatic carbon atoms provided by the $R^*$ groups in each compound represented by Formula XIII.

The aromatic group Ar in Formula XIII may have the same structure as any of the aromatic groups Ar discussed below under the heading "Phenols". Examples of the aromatic groups that are useful herein include the polyvalent aromatic groups derived from benzene, naphthalene, anthracene, etc., preferably benzene. Specific examples of Ar groups include phenylenes and naphthylene, e.g., methylphenylenes, ethoxyphenylenes, isopropylphenylenes, hydroxyphenylenes, dipropoxynaphthylenes, etc.

Examples of the $R^*$ groups in Formula XIII include butyl, isobutyl, pentyl, octyl, nonyl, dodecyl, and substituents derived from polymerized olefins such as polyethylenes, polypropylenes, polyisobutylenes, ethylene-propylene copolymers, oxidized ethylene-propylene copolymers, and the like.

Within this group of aromatic acids, a useful class of carboxylic acids are those of the formula

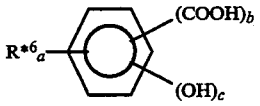

(XIV)

wherein in Formula XIV, $R^{*6}$ is an aliphatic hydrocarbyl group preferably containing from about 4 to about 400 carbon atoms, a is a number in the range of from zero to about 4, preferably 1 to about 3; b is a number in the range of I to about 4, preferably I to about 2, c is a number in the range of 1 to about 4, preferably 1 to about 2, and more preferably 1; with the proviso that the sum of a, b and c does not exceed 6. Preferably, $R^{*6}$ and a are such that the acid molecules contain at least an average of about 12 aliphatic carbon atoms in the aliphatic hydrocarbon substituents per acid molecule.

Also useful are the aliphatic hydrocarbon-substituted salicyclic acids wherein each aliphatic hydrocarbon substituent contains an average of at least about 8 carbon atoms per substituent and 1 to 3 substituents per molecule. Salts prepared from such salicyclic acids wherein the aliphatic hydrocarbon substituents are derived from polymerized olefins, particularly polymerized lower 1-mono-olefins such as polyethylene, polypropylene, polyisobutylene, ethylene/propylene copolymers and the like and having average carbon contents of about 30 to about 400 carbon atoms are particularly useful.

The aromatic carboxylic acids corresponding to Formulae XIII and XIV above are well known or can be prepared according to procedures known in the art. Carboxylic acids of the type illustrated by these formulae and processes for preparing their neutral and basic metal salts are well known and disclosed, for example, in U.S. Pat. Nos. 2,197,832; 2,197,835; 2,252,662; 2,252,664; 2,714,092; 3,410,798; and 3,595,791.

Sulfonic Acids

The sulfonic acids useful in making salts (B) of the invention include the sulfonic and thiosulfonic acids. Generally they are salts of sulfonic acids.

The sulfonic acids include the mono- or polynuclear aromatic or cycloaliphatic compounds. The oilsoluble sulfonates can be represented for the most part by the following formulae:

$$R^{\#1}_a\text{—T—}(SO_3)_b \quad \text{(XV)}$$

$$R^{\#2}\text{—}(SO_3)_a \quad \text{(XVI)}$$

In the above Formulae XV and XVI, T is a cyclic nucleus such as, for example, benzene, naphthalene, anthracene, diphenylene oxide, diphenylene sulfide, petroleum naphthenes, etc.; $R^{\#1}$ is an aliphatic group such as alkyl, alkenyl, alkoxy, alkoxyalkyl, etc.; a is at least 1, and $R^{\#1}_a$+T contains a total of at least about 15 carbon atoms. $R^{\#2}$ is an aliphatic hydrocarbyl group containing at least about 15 carbon atoms. Examples of $R^{\#2}$ are alkyl, alkenyl, alkoxyalkyl, carboalkoxyalkyl, etc. Specific examples of $R^{\#2}$ are groups derived from petrolatum, saturated and unsaturated paraffin wax, and polyolefins, including polymerized, $C_2$, $C_3$, $C_4$, $C_5$, $C_6$, etc., olefins containing from about 15 to 7000 or more carbon atoms. The groups T, $R^{\#1}$ and $R^{\#2}$ in the above Formulae XV and XVI can also contain other inorganic or organic substituents in addition to those enumerated above such as, for example, hydroxy, mercapto, halogen, nitro, amino, nitroso, sulfide, disulfide, etc. In Formula XV, a and b are at least 1, and likewise in Formula XVI, a is at least 1.

Specific examples of oil-soluble sulfonic acids are mahogany sulfonic acids; bright stock sulfonic acids; sulfonic acids derived from lubricating oil fractions having a Saybolt viscosity from about 100 seconds at 100° F. to about 200 seconds at 210° F.; petrolatum sulfonic acids; mono- and poly-wax-substituted sulfonic and polysulfonic acids of, e.g., benzene, naphthalene, phenol, diphenyl ether, naphthalene disulfide, etc.; other substituted sulfonic acids such as alkyl benzene sulfonic acids (where the alkyl group has at least 8 carbons), cetylphenol mono-sulfide sulfonic acids, dilauryl beta naphthyl sulfonic acids, and alkaryl sulfonic acids such as dodecyl benzene "bottoms" sulfonic acids.

Dodecyl benzene "bottoms" sulfonic acids are the material leftover after the removal of dodecyl benzene sulfonic acids that are used for household detergents. These materials are generally alkylated with higher oligomers. The bottoms may be straight-chain or branched-chain alkylates with a straight-chain dialkylate preferred.

The production of sulfonates from detergent manufactured by-products by reaction with, e.g., $SO_3$, is well known to those skilled in the art. See, for example, the article "Sulfonates" in Kirk-Othmer "Encyclopedia of Chemical Technology", Second Edition, Vol. 19, pp. 291 et seq. published by John Wiley & Sons, N. Y. (1969).

Also included are aliphatic sulfonic acids such as paraffin wax sulfonic acids, unsaturated paraffin wax sulfonic acids, hydroxy-substituted paraffin wax sulfonic acids, hexapropylene sulfonic acids, tetra-amylene sulfonic acids, polyisobutene sulfonic acids wherein the polyisobutene contains from 20 to 7000 or more carbon atoms, chloro-substituted paraffin wax sulfonic acids, etc.; cycloaliphatic sulfonic acids such as petroleum naphthene sulfonic acids, lauryl cyclohexyl sulfonic acids, mono- or poly-wax-substituted cyclohexyl sulfonic acids, etc.

With respect to the sulfonic acids or salts thereof described herein and in the appended claims, it is intended herein to employ the term "petroleum sulfonic acids" or "petroleum sulfonates" to cover all sulfonic acids or the salts thereof derived from petroleum products. A useful group of petroleum sulfonic acids are the mahogany sulfonic acids (so called because of their reddish-brown color) obtained as a by-product from the manufacture of petroleum white oils by a sulfuric acid process.

Generally neutral and basic salts of the above-described synthetic and petroleum sulfonic acids are useful in the practice of this invention.

Phosphorus-Containing Acids

The phosphorus-containing acid may be any of the acids described below under Component D-1 or Component D-3.

In a preferred embodiment, the phosphorus-containing acid is the reaction product of an olefin polymer and phosphorus sulfide. The olefin polymers generally have a molecular weight of at least 150 up to about 48,000, preferably from about 500 to about 5000. The polymers include homopolymers and interpolymers of monolefins having from 2 to about 12 carbon atoms. Examples of useful monolefins include ethylene, propylene, butylene, hexylene, etc.

Useful phosphorus sulfide-containing sources include phosphorus pentasulfide, phosphorus sesquisulfide, phosphorus heptasulfide and the like.

The reaction of the olefin polymer and the phosphorus sulfide generally may occur by simply mixing the two at a temperature above 80° C., preferably between 100° C. and 300° C. Generally, the products have a phosphorus content from about 0.05% to about 10%, preferably from about 0.1% to about 5%. The relative proportions of the phosphorizing agent to the olefin polymer is generally from 0.1 part to 50 parts of the phosphorizing agent per 100 parts of the olefin polymer.

The phosphorus-containing acids useful in the present invention are described in U.S. Pat. No. 3,232,883 issued to Le Suer. This reference is herein incorporated by reference for its disclosure to the phosphorus-containing acids and methods for preparing the same.

Phenols

The phenols useful in making the borated salts (B) of the invention can be represented by the formula $$R^{\#3}_{a}—Ar—(OH)_{b} \qquad \text{(XVIII)}$$

wherein in Formula XVIII, $R^{\#3}$ is a hydrocarbyl group of from about 4 to about 400 carbon atoms; Ar is an aromatic group; a and b are independently numbers of at least one, the sum of a and b being in the range of two up to the number of displaceable hydrogens on the aromatic nucleus or nuclei of Ar. Preferably, a and b are independently numbers in the range of 1 to about 4, more preferably I to about 2. $R^{\#3}$ and a are preferably such that there is an average of at least about 8 aliphatic carbon atoms provided by the $R^{\#3}$ groups for each phenol compound represented by Formula XVIII.

While the term "phenol" is used herein, it is to be understood that this term is not intended to limit the aromatic group of the phenol to benzene. Accordingly, it is to be understood that the aromatic group as represented by "Ar" in Formula XII, as well as elsewhere in other formulae in this specification and in the appended claims, can be mononuclear such as a phenyl, a pyridyl, or a thienyl, or polynuclear. The polynuclear groups can be of the fused type wherein an aromatic nucleus is fused at two points to another nucleus such as found in naphthyl, anthranyl, etc. The polynuclear group can also be of the linked type wherein at least two nuclei (either mononuclear or polynuclear) are linked through bridging linkages to each other. These bridging linkages can be chosen from the group consisting of alkylene linkages, ether linkages, keto linkages, sulfide linkages, polysulfide linkages of 2 to about 6 sulfur atoms, etc.

The number of aromatic nuclei, fused, linked or both, in Ar can play a role in determining the integer values of a and b in Formula XVIII. For example, when Ar contains a single aromatic nucleus, the sum of a and b is from 2 to 6. When Ar contains two aromatic nuclei, the sum of a and b is from 2 to 10. With a tri-nuclear Ar moiety, the sum of a and b is from 2 to 15. The value for the sum of a and b is limited by the fact that it cannot exceed the total number of displaceable hydrogens on the aromatic nucleus or nuclei of Ar.

The $R^{\#3}$ group in Formula XVIII is a hydrocarbyl group that is directly bonded to the aromatic group Ar. $R^{\#3}$ preferably contains about 6 to about 80 carbon atoms, preferably about 6 to about 30 carbon atoms, more preferably about 8 to about 25 carbon atoms, and advantageously about 8 to about 15 carbon atoms. Examples of $R^{\#3}$ groups include butyl, isobutyl, pentyl, octyl, nonyl, dodecyl, 5-chlorohexyl, 4-ethoxypentyl, 3-cyclohexyloctyl, 2,3,5-trimethylheptyl, and substituents derived from polymerized olefins such as polyethylenes, polypropylenes, polyisobutylenes, ethylene-propylene copolymers, chlorinated olefin polymers, oxidized ethylene-propylene copolymers, propylene tetramer and tri(isobutene).

Metal Compounds

The metal compounds useful in making the borated overbased metal salts of the organic acids are generally any Group I or Group II metal compounds (CAS version of the Periodic Table of the Elements). The Group I metals of the metal compound include alkali metals ( sodium, potassium, etc.) as well as Group IB metals such as copper. The Group I metals are preferably sodium, potassium and copper, more preferably sodium or potassium, and more preferably sodium. The Group II metals of the metal base include the alkaline earth metals (magnesium, calcium, barium, etc.) as well as the Group IIB metals such as zinc or cadmium. Preferably the Group II metals are magnesium, calcium, or zinc, preferably magnesium or calcium, more preferably magnesium.

Generally the metal compounds are delivered as metal salts. The anionic portion of the salt can be hydroxyl, oxide, carbonate, borate, nitrate, etc.

Acidic Materials

As described above, the borated overbased compounds may be prepared by the reaction of a borating compound with an overbased metal salt or the borating compound may react directly with the metal compound and organic acid.

An acidic material is used to accomplish the formation of the overbased salt. The acidic material may be a liquid such as formic acid, acetic acid, nitric acid, sulfuric acid, etc. Acetic acid is particularly useful. Inorganic acidic materials may also be used such as HCl, $SO_2$, $SO_3$, $CO_2$, $H_2S$, etc. A preferred combination of acidic materials is carbon dioxide and acetic acid.

A promoter is a chemical employed to facilitate the incorporation of metal into the basic metal compositions. Among the chemicals useful as promoters are water, ammonium hydroxide, organic acids of up to about 8 carbon atoms, nitric acid, sulfuric acid, hydrochloric acid, metal complexing agents such as alkyl salicylaldoxime, and alkali metal hydroxides such as lithium hydroxide, sodium hydroxide and potassium hydroxide, and mono- and polyhydric alcohols of up to about 30 carbon atoms. Examples of the alcohols include methanol, ethanol, isopropanol, dodecanol, behenyl alcohol, ethylene glycol, monomethylether of ethylene glycol, hexamethylene glycol, glycerol, pentaerythritol, benzyl alcohol, phenylethyl alcohol, aminoethanol, cinnamyl alcohol, allyl alcohol, and the like. Especially useful are the monohydric alcohols having up to about 10 carbon atoms and mixtures of methanol with higher monohydric alcohols.

Patents specifically describing techniques for making basic salts of the hereinabove-described sulfonic acids, carboxylic acids, and mixtures of any two or more of these include U.S. Pat. Nos. 2,501,731; 2,616,905; 2,616,911; 2,616,925; 2,777,874; 3,256,186; 3,384,585; 3,365,396; 3,320,162; 3,318,809; 3,488,284; and U.S. Pat. No. 3,629,109. The disclosures of these patents are hereby incorporated in this present specification for their disclosures in this regard as well as for their disclosure of specific suitable basic metal salts.

Borating Compounds

The borating compounds include boron oxide, boron oxide hydrate, boron trioxide, boron trifluoride, boron tribromide, boron trichloride, boron acids such as boronic acid (i.e., alkyl-$B(OH)_2$ or aryl-$B(OH)_2$), boric acid (i.e., $H_3BO_3$), tetraboric acid (i.e., $H_2B_4O_7$), metaboric acid (i.e., $HBO_2$), boron anhydrides, boron amides and various esters of such boron acids. The use of complexes of boron trihalide with ethers, organic acids, inorganic acids, or hydrocarbons is a convenient means of introducing the boron reactant into the reaction mixture. Such complexes are known and are exemplified by boron-trifluoride-triethyl ester, boron trifluoride-phosphoric acid, boron trichloride-chloroacetic acid, boron tribromide-dioxane, and boron trifluoride-methyl ethyl ether.

Specific examples of boronic acids include methyl boronic acid, phenyl-boronic acid, cyclohexyl boronic acid, p-heptylphenyl boronic acid and dodecyl boronic acid.

The boron acid esters include especially mono-, di-, and tri-organic esters of boric acid with alcohols or phenols such as, e.g., methanol, ethanol, propanol, 1-octanol, benzyl alcohol, ethylene glycol, glycerol, Cellosolve, phenol. Lower alcohols, 1,2-glycols, and 1-3-glycols, i.e., those having less than about 8 carbon atoms are especially useful for preparing the boric acid esters for the purpose of this invention. Methods for preparing the esters of boron acid are known and disclosed in the art (such as "Chemical Reviews," pp. 959–1064, Vol. 56).

The boron-containing salts (A) are preferably formed by reacting the organic acid (1) with a portion of the metal-containing compound (2) to form a neutral metal salt of an organic acid. Additional metal-containing compound (2) is then added along with the boron compound (3) and promoter (4). The contents are heated to reflux and held at reflux for several hours.

Preferred ratios of components (1), (2), (3) and (4) for the above reaction can be determined by the equation (wherein Eqs. means equivalents):

$$\text{Ratio} = \frac{\text{Moles of Boron}}{\text{Eqs of(2)} - \text{Eqs of(1)} - \text{Eqs of acid in(4)} + \text{Eqs of base in(4)}}$$

This ratio is preferably in the range of about 0.2 to about 3, more preferably about 0.3 to about 2.

For purposes of the above equation, one mole of boron is equal to the number of moles of the boron compound (3) times the number of borons present in that boron compound. Thus, if 3.2 moles of boric acid $H_3$-$BO_3$ are used, then the number of moles of boron is 3.2 times 1 or 3.2. If 2 moles of tetraboric acid $H_2B_4$-$O_7$ are used, the number of moles of boron is $2\times4$ or 8.

For the purposes of the above equation, one equivalent of a metal is equal to the molecular weight of that metal divided by the valence of the metal ion. Thus, an equivalent weight of sodium is 23 (i.e., 23 divided by $1=23$) while an equivalent weight of calcium is 20 (i.e., 40 divided by $2=20$).

The above reactions may be carried out in the presence of a substantially inert liquid solvent/diluent medium. This solvent/diluent medium desirably serves to maintain contact of the components and facilitates control of the reaction temperature. Examples of suitable solvent/diluent media include aliphatic and aromatic hydrocarbons such as benzene, toluene, naphtha, mineral oil, hexane, chlorinated hydrocarbons such as dichlorobenzene and heptylchloride, and ethers such as methyl n-amylether and n-butylether.

Borated overbased compositions, lubricating compositions containing the same and methods of preparing borated overbased compositions are found in U.S. Pat. No. 4,744,920 issued to Fischer et al; U.S. Pat. No. 4,792,920 issued to Schwind et al and PCT Publication WO 88/03144. The disclosures relating to the above are hereby incorporated by reference.

The following examples relate to borated overbased salts of organic acids (B). Unless indicated otherwise, parts are parts by weight, temperature is in degrees C, and pressure is at or near atmospheric.

Example B-1

A sodium carbonate overbased (20:1 equivalent) sodium sulfonate is mixed with a diluent oil in a suitable reaction vessel. The diluent oil is mineral oil. The mixture of the sodium carbonate overbased sodium sulfonate and the diluent oil is heated to 75° C. Boric acid is then added slowly without substantially changing the temperature of the mixture.

The reaction mixture is then slowly heated to 100° C. over a period of about 1 hour while removing substantially all of the distillate. The carbon dioxide is observed to be removed without substantial foaming. The product is then further heated to 150° C. for about 3 hours while removing all of the distillate. It is observed that at the latter temperature, substantially all of the water is removed and very little of the carbon dioxide is evolved from the product. The product is then held for another hour at 150° C. until the water content of the product is less than about 0.3%.

The product is recovered by allowing it to cool to 100° C.–120° C. followed by filtration. The recovered filtrate of high clarity is the product.

Example B-2

A charge of 800 parts of toluene and 400 parts of boric acid are added to a reaction vessel. The charge is heated to 85° C. and 1600 parts of a magnesium carbonate overbased magnesium sulfonate (15:1 metal to sulfonate equivalent ratio) are added. The temperature is observed to drop to 70° C. due to the addition of the cooler component. The temperature is then raised to 102° C. and held for three hours. The water is removed by azeotroping at the toluene reflux. The product is then stripped at 160° C. to remove the toluene. The product has a magnesium content of 7.35% out of a theoretical 8.73%, a boron content of 3.94% out of 4.2% theory, and a total base number of 369 out of 376.

Example B-3

A charge of 800 parts of toluene and 400 parts of boric acid is added to a reaction vessel. The contents are heated to 60° C. and 1600 parts of a calcium carbonate overbased calcium sulfonate (20:1 equivalent ratio) are added and the resulting mixture is heated to 88° C. and held for 2 hours. Polyisobutenyl succinic anhydride (number average molecular weight is about 1000) at 100 parts, is then added. The product is then obtained as in Example B-2. The calcium content is 13%, the boron is 3.15% and the total base number is 349. The theory figures are 13.3%, 3.83% and 343, respectively.

Example B-4

A mixture of 561 parts (1 equivalent) of a primary branched chain monoalkyl benzene sulfonic acid (molecular weight of 500), 100 parts toluene, 122 parts isobutyl alcohol and 78 parts amyl alcohol is prepared. The contents are stirred and heated to 54° C. and added are 51 parts (1.25 equivalents) zinc oxide and 40 parts water. The temperature is slowly increased to reflux of about 98° C. and held for 2.5 hours. Volatiles are then removed at 150° C. At 28° C. added are 400 parts mineral oil, 350 parts toluene, 61 parts isobutyl alcohol and parts amyl alcohol. At 50° C. are added 79 parts (1.94 equivalents) zinc oxide and 124 parts (2 equivalents) boric acid. Temperature is increased to reflux of 92° C. over 1.3 hours. A solution of 10 parts zinc chloride and 90 parts water is added and reflux is maintained for an additional 7 hours. Volatiles are removed at 150° C. and 8 torr and the contents are filtered to remove any solids. Analyses: basic neutralization number, 100; ratio: 0.85.

Component (C)

The polysulfide compositions useful in the present invention are generally characterized as having sulfide linkages having from at least 2 to about 10 sulfur atoms, preferably 2 to about 6 sulfur atoms, more preferably 2 to about 4 sulfur atoms. The polysulfide compositions useful in the present invention are generally di-, tri- or tetrasulfide compositions with trisulfide compositions preferred. For purposes of the present invention, the polysulfide composition may be a mixture of di-, tri- or tetrasulfide materials with materials having a majority of trisulfide being preferred. Materials having at least 70% trisulfide are preferred, with materials containing greater than 80% trisulfide more preferred.

The polysulfide compositions of the present invention provide from about 1 to about 3% sulfur to the lubricating compositions. Generally, the polysulfide compositions contain from about 10 to about 60% sulfur, preferably 20 to about 50%, and more preferably about 35 to about 45% sulfur.

Materials which may be sulfurized to form the polysulfide compositions of the present invention include oils, faulty acids or esters, or olefins or polyolefins made thereof.

Oils which may be sulfurized are natural or synthetic oils including mineral oils, lard oil, carboxylic acid esters derived from aliphatic alcohols and fatty acids or aliphatic carboxylic acids (e.g., myristyl oleate and oleyl oleate) sperm whale oil and synthetic sperm whale oil substitutes and synthetic unsaturated esters or glycerides.

Fatty acids generally contain from about 4 to about 22 carbon atoms such as palmitoleic, oleic, ricinoleic, linoleic, oleostearic, etc. Sulfurized fatty acid esters prepared from mixed unsaturated fatty acid esters such as are obtained from animal fats and vegetable oils such as tall oil, linseed oil, rape oil, fish oil, sperm oil, etc., also are useful.

The olefinic compounds which may be sulfurized are diverse in nature. They contain at least one olefinic double bond, which is defined as a non-aromatic double bond; that is, one connecting two aliphatic carbon atoms. In its broadest sense, the olefin may be defined by the formula $$R^{*1}R^{*2}C{=}CR^{*3}R^{*4}$$

wherein each of $R^{*1}$, $R^{*2}$, $R^{*3}$ and $R^{*4}$ is hydrogen or an organic group. In general, the R groups in the above formula which are not hydrogen may be satisfied by such groups as $-C(R^{*5})_3$, $-COOR^{*5}$, $-CON(R^{*5})_2$, $-COON(R^{*5})4$, —COOM, —CN, —X, $-YR^{*5}$ or —Ar, wherein:

each $R^{*5}$ is independently hydrogen, alkyl, alkenyl, aryl, substituted alkyl, substituted alkenyl or substituted aryl, with the proviso that any two $R^{*5}$ groups can be alkylene or substituted alkylene whereby a ring of up to about 12 carbon atoms is formed;

M is one equivalent of a metal cation (preferably Group I or II, e.g., sodium, potassium, barium, calcium);

X is halogen (e.g., chloro, bromo, or iodo);

Y is oxygen or divalent sulfur;

Ar is an aryl or substituted aryl group of up to about 12 carbon atoms.

Any two of $R^{*1}$, $R^{*2}$, $R^{*3}$ and $R^{*4}$ may also together form an alkylene or substituted alkylene group; i.e., the olefinic compound may be alicyclic.

The olefinic compound is usually one in which each R group which is not hydrogen is independently alkyl, alkenyl or aryl group. Monoolefinic and diolefinic compounds, particularly the former, are preferred, and especially terminal monoolefinic hydrocarbons; that is, those compounds in which $R^{*3}$ and $R^{*4}$ are hydrogen and $R^{*1}$ and $R^{*2}$ are alkyl or aryl, especially alky 1 ( that is, the olefin is aliphatic) having 1 to about 30, preferably 1 to about 16, more preferably 1 to about 8, and more preferably 1 to about 4 carbon atoms. Olefinic compounds having about 3 to 30 and especially about 3 to 16 (most often less than 9) carbon atoms are particularly desirable.

Isobutene, propylene and their dimers, trimers and tetramers, and mixtures thereof are especially preferred olefinic compounds. Of these compounds, isobutylene and diisobutylene are particularly desirable because of their availability and the particularly high sulfur-containing compositions which can be prepared therefrom.

In one preferred embodiment, the polysulfide compositions comprise sulfurized olefins, where the olefins are described above. For example, organic polysulfides may be prepared by the sulfochlorination of olefins containing four or more carbon atoms and further treatment with inorganic higher polysulfides according to U.S. Pat. No. 2,708,199.

In one embodiment, sulfurized olefins are produced by (1) reacting sulfur monochloride with a stoichiometric excess of a low carbon atom olefin, (2) treating the resulting product with an alkali metal sulfide in the presence of free sulfur in a mole ratio of no less than 2:1 in an alcohol-water solvent, and (3) reacting that product with an inorganic base. This procedure is described in U.S. Pat. No. 3,471,404, and the disclosure of U.S. Pat. No. 3,471,404 is hereby incorporated by reference for its discussion of this procedure for preparing sulfurized olefins and the sulfurized olefins thus produced. Generally, the olefin reactant contains from about 2 to 5 carbon atoms and examples include ethylene, propylene, butylene, isobutylene, amylene, etc.

The sulfurized olefins which are useful in the compositions of the present invention also may be prepared by the reaction, under superatmospheric pressure, of olefinic compounds with a mixture of sulfur and hydrogen sulfide in the presence of a catalyst, followed by removal of low boiling materials. This procedure for preparing sulfurized compositions which are useful in the present invention is described in U.S. Pat. No. 4,191,659, the disclosure of which is hereby incorporated by reference for its description of the preparation of useful sulfurized compositions.

The following examples relate to polysulfide compositions.

Example C-1

Sulfur (526 parts, 16.4 moles) is charged to a jacketed, high-pressure reactor which is fitted with an agitator and internal cooling coils. Refrigerated brine is circulated through the coils to cool the reactor prior to the introduction of the gaseous reactants. After sealing the reactor, evacuating to about 2 torr and cooling, 920 parts (16.4 moles) of isobutene and 279 parts (8.2 moles) of hydrogen sulfide are charged to the reactor. The reactor is heated using steam in the external jacket, to a temperature of about 182° C. over about 1.5 hours. A maximum pressure of 1350 psig is reached at about 168° C. during this heat-up. Prior to reaching the peak reaction temperature, the pressure starts to decrease and continues to decrease steadily as the gaseous reactants are consumed. After about 10 hours at a reaction temperature of about 182° C., the pressure is 310–340 psig and the rate of pressure change is about 5–10 psig per hour. The unreacted hydrogen sulfide and isobutene are vented to a recovery system. After the pressure in the reactor has decreased to atmospheric, the sulfurized mixture is recovered as a liquid.

The mixture is blown with nitrogen at about 100° C. to remove low boiling materials including unreacted isobutene, mercaptans and monosulfides. The residue after nitrogen blowing is agitated with 5% Super Filtrol and filtered, using a diatomaceous earth filter aid. The filtrate is the desired sulfurized composition which contains 42.5% sulfur.

Example C-2

Sulfur monochloride (2025 parts, 15.0 moles) is heated to 45° C. Through a sub-surface gas sparger, 1468 parts (26.2 moles) of isobutylene gas are fed into the reactor over a 5-hour period. The temperature is maintained between 45°–50° C. At the end of the sparging, the reaction mixture increases in weight of 1352 parts.

In a separate reaction vessel are added 2150 parts (16.5 moles) of 60% flake sodium sulfide, 240 parts (7.5 moles) sulfur, and a solution of 420 ml. of isopropanol in 4000 ml. of water. The contents are heated to 40° C. The adduct of the sulfur monochloride and isobutylene previously prepared is added over a three-quarter hour period while permitting the temperature to rise to 75° C. The reaction mixture is refluxed for 6 hours, and afterward the mixture is permitted to form into separate layers. The lower aqueous layer is discarded. The upper organic layer is mixed with two liters of 10% aqueous sodium hydroxide, and the mixture is refluxed for 6 hours. The organic layer is again removed and washed with one liter of water. The washed product is dried by heating at 90° C. and 30 mm. Hg. pressure for 30 minutes. The residue is filtered through diatomaceous earth filter aid to give 2070 parts of a clear yellow-orange liquid.

Component (D)

The phosphorus-containing compositions of the present invention may be any phosphorus acid; or salt or derivative, other than a zinc dithiophosphate, which provides effective extreme pressure properties to the lubricant. The phosphorus acids useful in the present invention are phosphoric; phosphonic; phosphinic; thiophosphoric; including dithiophosphoric as well as monothiophosphoric, thiophosphinic or thiophosphonic acids. The use of the term thiophosphoroic, thiophosphonic or thiophosphinic acids is also meant to encompass monothio as well as dithio derivatives of these acids. Useful phosphorus-containing compositions are described below.

Component D-1

The phosphorus-containing compositions of the present invention include (D-1) a compound represented by the formula

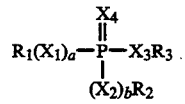

(I)

wherein each $X_1$, $X_2$, $X_3$ and $X_4$ is independently oxygen or sulfur; each a and b is independently 0 or 1; and wherein each $R_1$, $R_2$ and $R_3$ is independently hydrogen, hydrocarbyl, or

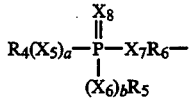

(II)

wherein each $R_4$ and $R_5$ is independently hydrogen or hydrocarbyl, provided at least one of $R_4$ and $R_5$ is hydrocarbyl, $R_6$ is an alkylene or alkylidene group, each a and b is independently 0 or 1, and each X5, X6, $X_7$ and $X_8$ is independently oxygen or sulfur.

In one embodiment, a and b are 1, and X1, $X_2$, $X_3$ and $X_4$ are oxygen.

In one embodiment, each $R_1$, $R_2$ and $R_3$ of Formula I is independently a hydrogen or a hydrocarbyl group. It is preferred that at least one of $R_1$, $R_2$ and $R_3$ is a hydrocarbyl group. In another embodiment, each $R_1$ and $R_2$ is independently a hydrocarbyl group and $R_3$ is a hydrogen. In yet another embodiment, each $R_1$, $R_2$ and $R_3$ is independently a hydrocarbyl group.

When $R_1$, $R_2$ or $R_3$ is a hydrocarbyl group they contain from 1 to about 30 carbon atoms, preferably 1 to about 24 carbon atoms, more preferably 1 to about 12 carbon atoms. In a preferred embodiment, each $R_1$, $R_2$ and $R_3$ is independently an alkyl or aryl group having the same carbon atom ranges as those defined for hydrocarbyl groups. When any $R_1$, $R_2$ or $R_3$ is an aryl group it contains from 6 to about 24 carbon atoms, more preferably 6 to about 18 carbon atoms.

Each $R_1$, $R_2$ and $R_3$ is independently a butyl, amyl, hexyl, octyl, oleyl or cresyl, with octyl and cresy being preferred. In a preferred embodiment, each of $R_1$, $R_2$ and $R_3$ are cresyl groups. In another embodiment, $R_1$ and $R_2$ are ethyl hexyl groups, and $R_3$ is a hydrogen.

The $R_1$, $R_2$ and $R_3$ groups may each comprise a mixture of hydrocarbyl groups derived from commercial alcohols. Higher synthetic monohydric alcohols of the type formed by Oxo process (e.g., 2-ethylhexyl), the Aldol condensation, or by organo aluminum-catalyzed oligomerization of alpha-olefins (especially ethylene), followed by oxidation and hydrolysis, also are useful.

Examples of some preferred monohydric alcohols and alcohol mixtures include the commercially available "Alfol" alcohols marketed by Continental Oil Corporation. Alfol 810 is a mixture containing alcohols consisting essentially of straight chain, primary alcohols having from 8 to 10 carbon atoms. Alfol 12 is a mixture comprising mostly $C_{12}$ fatty alcohols. Alfol I 218 is a mixture of synthetic, primary, straight-chain alcohols having 12 to 18 carbon atoms. The Alfol 20+ alcohols are mixtures of $C_{18-C28}$ primary alcohols having mostly, on an alcohol basis, $C_{20}$ alcohols as determined by GLC (gas-liquid-chromatography). The Alfol 22+ alcohols are $C_{18}$–$C_{28}$ primary alcohols having mostly, on an alcohol basis, $C_{22}$ alcohols. These Alfol alcohols can contain a fairly large percentage (up to 40% by weight) of paraffinic compounds which can be removed before the reaction if desired.

Another example of a commercially available alcohol mixture is Adol 60 which comprises about 75% by weight of a straight chain $C_{22}$ primary alcohol, about 15% of a $C_{20}$ primary alcohol and about 8% of $C_{18}$ and $C_{24}$ alcohols. Adol 320 comprises predominantly oleyl alcohol. The Adol alcohols are marketed by Ashland Chemical.

A variety of mixtures of monohydric fatty alcohols derived from naturally occurring triglycerides and ranging in chain length of from $C_8$ to $C_{18}$ are available from Procter & Gamble Company. These mixtures contain various amounts of fatty alcohols containing mainly 12, 14, 16, or 18 carbon atoms. For example, CO-1214 is a fatty alcohol mixture containing 0.5% of $C_{10}$ alcohol, 66.0% of $C_{12}$ alcohol, 26.0% of $C_{14}$ alcohol and 6.5% of $C_{16}$ alcohol.

Another group of commercially available mixtures include the "Neodol" products available from Shell Chemical Co. For example, Neodol 23 is a mixture of $C_{12}$ and $C_{13}$ alcohols; Neodol 25 is a mixture of $C_{12}$ and $C_{15}$ alcohols; and Neodol 45 is a mixture of $C_{14}$ to $C_{15}$ linear alcohols. Neodol 91 is a mixture of $C_9$, $C_{10}$ and $C_{11}$ alcohols.

Fatty vicinal diols also are useful and these include those available from Ashland Oil under the general trade designation Adol 114 and Adol 158. The former is derived from a straight chain alpha olefin fraction of $C_{11}$–$C_{14}$, and the latter is derived from a $C_{15}$—$C_{18}$ fraction.

In one embodiment, when a and b are 1, and one of $X_1$, $X_2$, $X_3$ or $X_4$ is sulfur and the rest are oxygen, the phosphorus-containing composition is characterized as a monothiophosphoric acid or monothiophosphate.

The monothiophosphoric acids may be characterized by one or more of the following formulae

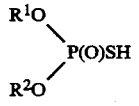

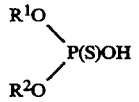

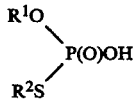

wherein $R^1$ and $R^2$ are as defined above, preferably each $R_1$ and $R_2$ is independently a hydrocarbyl group.

Monothiophosphates are prepared by the reaction of a sulfur source and a dihydrocarbyl phosphite. The sulfur source may be elemental sulfur or a sulfur compound like those described under polysulfides. The sulfur source may also be a monosulfide, such as sulfur. coupled olefins and fatty acids or ester, as well as sulfur coupled dithiophosphates. Elemental sulfur is a preferred sulfur source.

A dihydrocarbyl phosphite useful in preparing the monothiophosphate is described below under Component (D-3). The preparation of monothiophosphates is disclosed in U.S. Pat. No. 4,755,311 and PCT Publication WO 87/07638 which are incorporated by reference for its disclosure of monothiophosphates, sulfur source for preparing monothiophosphates and the process for making monothiophosphates.

Monothiophosphates may be formed in the lubricant blend by adding a dihydrocarbyl phosphite to a lubricating composition containing a sulfur source. The phosphite may react with the sulfur source under blending conditions (i.e., temperatures from about 30° C. to about 100° C. or higher) to form the monothiophosphate. It is also possible that the monothiophosphate is formed under the conditions found when the lubricating composition is in an operating engine.

In Formula I, when a and b are 1; $X_1$ and $X_2$ are oxygen; and $X_3$ and $X_4$ are sulfur, the phosphorus-containing composition is characterized as a dithiophosphoric acid or phosphorodithioic acid.

The dithiophosphoric acid may be characterized by the formula

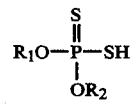

wherein $R_1$ and $R_2$ are as defined above, preferably $R_1$ and $R_2$ are hydrocarbyl groups.

The dihydrocarbyl phosphorodithioic acids may be prepared by reaction of alcohols with $P_2S_5$ between the temperature of about 50° C. to about 150° C. Often the alcohols or mixtures of alcohols are reacted with $P_2S_5$ to form the dithiophosphoric acids. Preparation of dithiophosphoric acids and their salts is well known to those of ordinary skill in the art.

In another embodiment, the phosphorus-containing composition is represented by Formula 1 where each $X_1$ and $X_2$ is oxygen, each $X_3$ and $X_4$ is sulfur, $R_3$ is hydrogen, and each $R_1$ and $R_2$ is independently hydrogen or

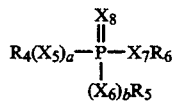

(II)

wherein the various R, a, b and X groups are as defined previously. Preferably either both $R_1$ and $R_2$ are the group of Formula II; or $R_1$ is hydrogen and $R_2$ is the group of Formula II.

Preferably, when each $R_4$ and $R_5$ is independently hydrocarbyl, they are the same as described for $R_1$ or $R_2$. Preferably, $X_5$ and $X_6$ are oxygen, and $X_7$ and $X_8$ are sulfur. Preferably $R_6$ is an arylene group, or an alkylene or alkylidene group having from 1 to about 12, more preferably from about 2 to about 6, more preferably about 3 carbon atoms. $R_6$ is preferably an ethylene, propylene, or butylene, more preferably a propylene group.

The group represented by Formula II is derived from a compound which is the reaction of a dithiophosphoric acid with an epoxide or a glycol. The dithlophosphoric acids are those described above. The epoxide is generally an aliphatic epoxide or a styrene oxide. Examples of useful epoxides include ethylene oxide, propylene oxide, butene oxide, octene oxide, dodecane oxide, styrene oxide, etc. Propylene oxide is preferred.

The glycols may be aliphatic glycols having from 1 to about 12, preferably about 2 to about 6, more preferably 2 or 3 carbon atoms, or aromatic glycols. Aliphatic glycols include ethylene glycol, propylene glycol, triethylene glycol and the like. Aromatic glycols include hydroquinone, catechol, resorcinol, and the like.

The reaction product of the dithiophosphoric acid and the glycol or epoxide is then reacted with an inorganic phosphorus reagent such as phosphorus pentoxide, phosphorus trioxide, phosphorus tetraoxide, phosphorus acid, phosphorus halides and the like. The above reaction is known in the art and is described in U.S. Pat. No. 3,197,405, issued to LeSuer. This patent is incorporated by reference for its disclosure of dithiophosphoric acids, glycols, epoxides, inorganic phosphorus reagents and methods of reacting the above.

Example D-1

Phosphorus pentoxide (64 grams, 0.45 mole) is added at 58° C. within a period of 45 minutes to hydroxypropyl O,O-di(4-methyl-2-pentyl)phosphorodithioate (514 grams, 1.35 moles, prepared by treating di(4-methyl-2-pentyl)-phosphorodithioic acid with 1.3 moles of propylene oxide at 25° C.). The mixture is heated at 75° C. for 2.5 hours, mixed with a filtering aid (diatomaceous earth), and filtered at 70° C. The filtrate is found to have a phosphorus content of 11.8%, a sulfur content of 15.2%, and an acid number of 87 (bromophenol blue indicator).

Example D-2

A mixture of 667 grams (4.7 moles) of phosphorus pentoxide and the hydroxypropyl O,O'-diisopropylphosphorodithioate prepared by the reaction of 3514 grams of diisopropyl phosphorodithioic acid with 986 grams of propylene oxide at 50° C. is heated at 85° C. for 3 hours and filtered. The filtrate has a phosphorus content of 15.3%, a sulfur content of 19.6%, and an acid number of 126 (bromophenol blue indicator).

Component (D-2)

When the phosphorus-containing compositions of (D-1) are acidic, they may be reacted with an amine compound or metallic base to form the corresponding ammonium or metal salt.

The salts may be formed separately and then added to the lubricating composition. The salts may also be formed when Component (D-1) is blended with other components to form the lubricating composition. Component (D-1) would then form salts with basic materials which are in the lubricating compositions such as basic nitrogen containing compounds (such as a dispersant) and overbased materials.

The ammonium salts of (D-1) may be formed from ammonia, or a primary, secondary or tertiary amine, or mixtures thereof.

In one preferred embodiment, the amines are primary hydrocarbyl amines containing from about 2 to about 30, more preferably about 4 to about 20, carbon atoms in the hydrocarbyl group. The hydrocarbyl group may be saturated or unsaturated. Representative examples of primary saturated amines are the alkyl amines such as methyl .amine, ethyl amine, n-propyl amine, n-butyl amine, n-amyl amine, n-hexyl amine; those known as aliphatic primary fatty amines and commercially known as "Armeen" primary amines (products available from Armak Chemicals, Chicago, Ill.). Typical fatty amines include alkyl amines such as n-hexylamine, n-octylamine, n-decylamine, n-dodecylamine, n-tetradecylamine, n-pentadecylamine, n-hexadecylamine, n-octadecylamine (stearyl amine), etc. Also suitable are mixed fatty amines such as Armak's Armeen-C, Armeen-0, Armeen-OD, Armeen-T, Armeen-HT, Armeen S and Armeen SD.

In another preferred embodiment, the ammonium salts of this invention are those derived from tertiaryaliphatic primary amines having from about 4 to about 30, preferably about 6 to about 24, more preferably about 8 to about 24, carbon atoms in the alkyl group.

Usually the tertiary aliphatic primary amines are monoamines represented by the formula

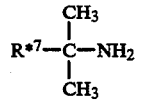

wherein $R^{*7}$ is a hydrocarbyl group containing from one to about 30 carbon atoms. Such amines are illustrated by tertiary-butyl amine, tertiary-hexyl primary amine, 1-methyl-1-amino-cyclohexane, tertiary-octyl primary amine, tertiary-decyl primary amine, tertiary-dodecyl primary amine, tertiary-tetradecyl primary amine, tertiary-hexadecyl primary amine, tertiary-octadecyl primary amine, tertiary-tetracosanyl primary amine, tertiary-octacosanyl primary amine.

Mixtures of amines are also useful for the purposes of this invention. Illustrative of amine mixtures of this type are "Primene 81R" which is a mixture of $C_{11}$–$C_{14}$ tertiary alkyl primary amines and "Primene JMT" which is a similar mixture of $C_{18}$–$C_{22}$ tertiary alkyl primary amines (both are available from Rohm and Haas Company). The tertiary alkyl primary amines and methods for their preparation are known to those of ordinary skill in the art. The tertiary alkyl primary amine useful for the purposes of this invention and methods for their preparation are described in U.S. Pat. No. 2,945,749 which is hereby incorporated by reference for its teaching in this regard.

Primary amines in which the hydrocarbon chain comprises olefinic unsaturation also are quite useful. Thus, the R' and R" groups may contain one or more olefinic unsaturations depending on the length of the chain, usually no more than one double bond per 10 carbon atoms. Representative amines are dodecenylamine, myristoleylamine, palmitoleylamine, oleylamine and linoleylamine. Such unsaturated amines also are available under the Armeen tradename.

Secondary amines include dialkylamines having two of the above alkyl groups described for primary amines including such commercial fatty secondary amines as Armeen 2C and Armeen HT, and also mixed dialkylamines where, for example, one alkyl group is a fatty amine and the other alkyl group may be a lower alkyl group (1–7 carbon atoms) such as methyl, ethyl, n-propyl, i-propyl, butyl, etc., or the other alkyl group may be an alkyl group bearing other non-reactive or polar substituents (CN, alkyl, carbalkoxy, amide, ether, thioether, halo, sulfoxide, sulfone) such that the essentially hydrocarbon character of the group is not destroyed.

Other useful primary amines are the primary ether amines $R''OR'NH_2$ wherein R' is a divalent alkylene group having 2 to 6 carbon atoms and R'' is a hydrocarbyl group of about 5 to about 150 carbon atoms. These primary ether amines are generally prepared by the reaction of an alcohol R''OH with an unsaturated nitrile. The R'' group of the alcohol can be a hydrocarbon-based group having up to about 150 carbon atoms. Typically, and for efficiency and economy, the alcohol is a linear or branched aliphatic alcohol with R'' having up to about 50 carbon atoms, preferably up to 26 carbon atoms and most preferably R'' has from 6 to 20 carbon atoms. The nitrile reactant can have from 2 to 6 carbon atoms with acrylonitrile being most preferred. Ether amines are known commercial products which are available under the name SURFAM" produced and marketed by Mars Chemical Company, Atlanta, Ga. Typical of such amines are those having from about 150 to about 400 molecular weight. Preferred etheramines are exemplified by those identified as SURFAM P14B (decyloxypropylamine), SURFAM P16A (linear $C_{16}$), SURFAM P17B (tridecyloxypropylamine). The carbon chain lengths (i.e., $C_{14}$, etc.) of the SURFAMS described above and used hereinafter are approximate and include the oxygen ether linkage. For example, a $C_{14}$ SURFAM would have the following general formula $$C_{10}H_{21}OC_3H_6NH_2$$

The amines used to form the ammonium salts may be hydroxyamines. In one embodiment, these hydroxyamines can be represented by the formula

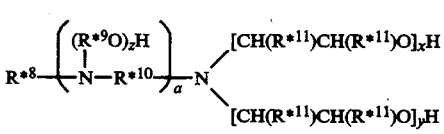

wherein $R^{*8}$ is a hydrocarbyl group generally containing from about 6 to about 30 carbon atoms, $R^{*9}$ is an ethylene or propylene group, $R^{*10}$ is an alkylene group containing up to about 5 carbon atoms, a is zero or one, each $R^{*11}$ is hydrogen or a lower alkyl group, and x, y and z are each independently integers from zero to about 10, at least one of x, y and z being at least 1.

The above hydroxyamines can be prepared by techniques well known in the art, and many such hydroxyamines are commercially available. They may be prepared, for example, by reaction of primary amines containing at least 6 carbon atoms with various amounts of alkylene oxides such as ethylene oxide, propylene oxide, etc. The primary amines may be single amines or mixtures of amines such as obtained by the hydrolysis of fatty oils such as tallow oils, sperm oils, coconut oils, etc. Specific examples of fatty acid amines containing from about 6 to about 30 carbon atoms include saturated as well as unsaturated aliphatic amines such as octyl amine, decyl amine, lauryl amine, stearyl amine, oleyl amine, myristyl amine, palmityl amine, dodecyl amine, and octadecyl amine.

The useful hydroxyamines where a in the above formula is zero include 2-hydroxyethylhexylamine, 2-hydroxyethyloctylamine, 2-hydroxyethylpentadecylamine, 2-hydroxyethyloleylamine, 2-hydroxyethylsoyamine, bis(2-hydroxyethyl)hexylamine, bis(2-hydroxyethyl)oleylamine, and mixtures thereof. Also included are the comparable members wherein in the above formula at least one of x and y is at least 2, as for example, 2-hydroxyethoxyethylhexylamine.

A number of hydroxyamines wherein a is zero are available from the Armak Chemical Division of Akzona, Inc., Chicago, Ill., under the general trade designation "Ethomeen" and "Propomeen". Specific examples of such products include "Ethomeen C/15" which is an ethylene oxide condensate of a coconut fatty acid containing about 5 moles of ethylene oxide; "Ethomeen C/20" and "C/25" which also are ethylene oxide condensation products from coconut fatty acid containing about 10 and 15 moles of ethylene oxide respectively; "Ethomeen 0/12" which is an ethylene oxide condensation product of oleyl amine containing about 2 moles of ethylene oxide per mole of amine. "Ethomeen S/15" and "S/20" which are ethylene oxide condensation products with stearyl amine containing about 5 and 10 moles of ethylene oxide per mole of amine respectively; and "Ethomeen T/12, T/15" and "T/25" which are ethylene oxide condensation products of tallow amine containing about 2, 5 and 15 moles of ethylene oxide per mole of amine respectively. "Propomeen 0/12" is the condensation product of one mole of oleyl amine with 2 moles propylene oxide.

Commercially available examples of alkoxylated amines where a is 1 include "Ethoduomeen T/13" and "T/20" which are ethylene oxide condensation products of N-tallow trimethylene diamine containing 3 and 10 moles of ethylene oxide per mole of diamine, respectively.

The fatty polyamine diamines include mono- or dialkyl, symmetrical or asymmetrical ethylene diamines, propane diamines (1,2, or 1,3), and polyamine analogs of the above. Suitable commercial fatty polyamines are "Duomeen C" (N-coco-1,3-diaminopropane), "Duomeen S" (N-soya-1,3-diaminopropane), "Duomeen T" (N-tallow-1,3-diaminopropane), or "Duomeen 0" (N-oleyl-1,3-diaminopropane). "Duomeens" are commercially available diamines described in Product Data Bulletin No. 7-10R1 of Armak Chemical Co., Chicago, Ill. In another embodiment, the secondary amines may be cyclic amines such as piperidine, piperazine, morpholine, etc.

The metal salts of (D-2) are prepared by the reaction of a metal base with (D-1). The metal base may be in any convenient form such as oxide, hydroxide, carbonate, sulfate, borate, or the like. The metals of the metal base are Group IA, and IIA, IB, through VIIB and VIII (CAS version of the Periodic Table of the Elements). The metals encompass the alkali metals, alkaline earth metals and transition metals.

Preferably the metal is a Group IIA metal such as calcium or magnesium; Group IIB metal such as zinc or a VIIB metal such as manganese. Preferably the metal is magnesium, calcium, manganese or zinc, more preferably magnesium, calcium or zinc, more preferably magnesium or zinc.

Example D-3

To 217 grams (0.5 equivalent) of the acidic filtrate of Example D-1 there is added at 25° to 60° C. within a period of 20 minutes, 66 grams (0.35 equivalent) of a commercial aliphatic primary amine having an average molecular weight of 191 in which the aliphatic radical is a mixture of tertiaryalkyl radicals containing from 11 to 14 carbon atoms. The partially neutralized product is found to have a phosphorus content of 10.2%, a nitrogen content of 1.5%, and an acid number of 26.3.

Example D-4

A portion of the filtrate of Example D-2 (1752 grams) is neutralized by treatment with a stoichiometrically equivalent amount (764 grams) of the aliphatic primary amine of Example D-3 at 25°–82° C. The neutralized product has a phosphorus content of 9.95%, a nitrogen content of 2.72%, and a sulfur content of 12.6%.

Example D-5

Iso-octyl alcohol (2340 parts, 18 moles) is charged to a 5-liter, 4-neck flask that is fitted with a stirrer, thermowell and a reflux condenser. Stirring is begun and 852 parts phosphorus pentoxide (6 moles) is added beginning at room temperature over a period of 3 hours. The addition is such that the temperature does not exceed 65° C. After addition is complete the contents are heated to 90° C. and maintained at that temperature for 3 hours. 30 parts of a siliceous filter aid is added, and the contents of the flask are filtered. The filtrate has a % phosphorus content of 12.4, an acid neutralization number to bromophenol blue of 192 and an acid neutralization number to phenolphthalein of 290. The filtrate (278 parts, liquid), obtained from Example D-5, is charged to a flask along with 200 parts toluene, 130 parts mineral oil, 1 part acetic acid in 10 parts water, and 45 parts zinc oxide (0.55 equivalents). The contents are heated to 60°–70° C. and 30 torr. The contents are filtered using a siliceous filter aid. Analyses: % zinc 8.58, % phosphorus 7.03.

Example D-6

Phosphorus pentoxide (208 grams, 1.41 moles) is added at 50° C. to 60° C. to hydroxypropyl O,O'-diisobutylphosphorodithioate (prepared by reacting 280 grams of propylene oxide with 1184 grams of O,O'-diisobutylphosphorodithioic acid at 30° C. to 60° C.). The reaction mixture is heated to 80° C. and held at that temperature for 2 hours. To the acidic reaction mixture there is added a stoichiometrically equivalent amount (384 grams) of the commercial aliphatic primary amine of Example D-3 to 30° C. to 60° C. The produce is filtered. The filtrate is found to have a phosphorus content of 9.31%, a sulfur content of 11.37%, a nitrogen content of 2.50%, and a base number of 6.9. (bromphenol blue indicator).

Component (D-3)

The phosphorus-containing compositions (D) may be (D-3) a phosphite represented by the following formula:

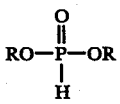

(III)

or $(RO)_3P$ (IV)

wherein in Formulae III and IV each R is independently hydrogen or a hydrocarbyl group having less than 16 carbon atoms provided at least one R is hydrocarbyl.

Preferably each R is independently a hydrogen or hydrocarbyl group having from 1 to about 24, more preferably from 1 to about 18, and more preferably from about 2 to about 8 carbon atoms. Each R may be independently alkyl, alkenyl or aryl. When R is aryl it contains at least 6 carbon atoms; preferably 6 to about 18 carbon atoms. Examples of alkyl or alkenyl groups are propyl, butyl, hexyl, heptyl, octyl, oleyl, linoleyl, stearyl, etc. Examples of aryl groups are phenyl, napthyl, heptylphenol, etc. Preferably each R is independently propyl, butyl, pentyl, hexyl, heptyl, oleyl or phenyl, more preferably butyl, oleyl or phenyl and more preferably butyl or oleyl.

Phosphites and their preparation are known and many phosphites are available commercially. Particularly useful phosphites are dibutylhydrogen phosphite, trioleyl phosphite and triphenyl phosphite.

Phosphorus-Containing Amides (D-4)

The phosphorus-containing amides (D-4) preferably comprise at least one compound represented by the formula:

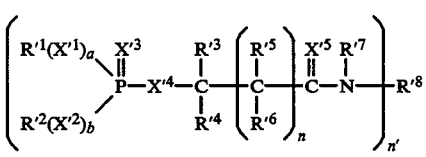

(V)

wherein each $X'^1$, $X'^2$, $X'^3$, $X'^4$ and $X'^5$ is independently oxygen or sulfur;

each $R'^1$ and $R'^2$ is independently a hydrocarbyl group;

each $R'^3$, $R'^4$, $R'^5$, $R'^6$ and $R'^7$ is independently a hydrogen, halogen or hydrocarbyl group;

a and b independently are zero or 1;

n is zero or 1;

n' is 1, 2 or 3; with the proviso that;

(1) when n' is 1, $R'^8$ is hydrogen, —R#, —ROH, —ROR, —RSR or

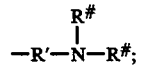

(2) when n' is 2, $R'^8$ is a coupling group selected from —R'—, —R*—, —R'—O—R'—, —R'—S—R'—,

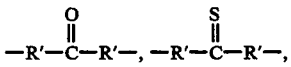

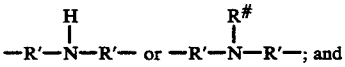

(3) when n' is 3, $R'^8$ is the coupling group

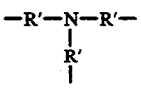

wherein each R# is independently a hydrocarbyl group of 1 to about 12 carbon atoms; and each R' is independently an arylene, or an alkylene or alkylidene group having from 1 to about 12 carbon atoms.

In Formula V $X'^1$, $X'^2$ and $X'^5$ are preferably oxygen. $X'^3$ and $X'^4$ are preferably sulfur and a and b are preferably 1.

Each $R'^1$ and $R'^2$of Formula V is independently a hydrocarbyl group of from 1 to about 50 carbon atoms, more preferably from 1 to about 30 carbon atoms, more preferably from about 3 to about 18 carbon atoms, more preferably from about 4 to about 8 carbon atoms. Each $R'^1$ and $R'^2$ is preferably an alkyl group. Examples of $R'^1$ and $R'^2$ are independently t-butyl, isobutyl, amyl, isooctyl, decyl, dodecyl, eicosyl, 2-pentenyl, dodecenyl, phenyl, naphthyl, alkylphenyl, alkylnaphtyl, phenylalkyl, naphthylalkyl, alkylphenylalkyl, alkylnaphthylalkyl groups, and the like.

Each $R'^3$, $R'^4$, $R'^5$, $R'^6$ and $R'^7$ of Formula V is independently a hydrogen or hydrocarbyl group of 1 from about 50 carbon atoms, more preferably 1 to about 30, more preferably I to about 18, more preferably 1 to about 8. Advantageously, each $R'^3$, $R'^4$, $R'^5$, $R'^6$ and $R'^7$ is independently a hydrogen; an alkyl group of from 1 to about 22 carbon atoms; a cycloalkyl group of from about 4 to about 22 carbon atoms; or an aromatic, an alkyl-substituted aromatic or an aromatic-substituted alkyl group of from about 4 to about 34 carbon atoms.

Preferably each R' is independently an alkylene or alkylidene group having from 1 to about 12, more preferably from 1 to about 6, more preferably 1 carbon atom. R' is preferably methylene, ethylene, or propylene with preferably methylene.

The phosphorus-containing amides (D-4) may be prepared by the reaction of a phosphorus-containing acid, preferably a dithiophosphoric acid, as described above with an acrylamide such as acrylamide, N,N'-methylenebisacrylamide, methacrylamide, crotonamide, and the like. The reaction product from above may be further reacted with linking or coupling compounds, such as formaldehyde or paraformaldehyde to form coupled compounds.

The phosphorus-containing amides are known in the art and are disclosed in U.S. Pat. Nos. 4,876,374, 4,770,807 and 4,670,169 which are incorporated by reference for its disclosure of the phosphorus amides, and their preparation.

Phosphorus-Containing Esters (D-5)

The phosphorus-containing esters (D-5) of the present invention may be characterized by the structural formula

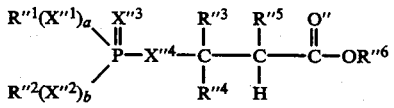

(VI)

wherein each $X''^1$, $X''^2$, $X''^3$ and $X''^4$ is independently oxygen or sulfur;

$R''^1$ and $R''^2$ are independently hydrocarbyl groups;

$R''^3$, $R''^4$ and $R''^5$ are independently hydrogen or hydrocarbyl groups;

$R''^6$ is a hydrocarbyl group; and a and b are independently zero or 1.

In Formula VI, $X''^1$ and $X''^2$ and are preferably oxygen, and $X''^3$ and $X''^4$ are preferably sulfur.

In Formula VI, each $R''^1$ and $R''^2$ is independently a hydrocarbyl group of from 1 to about 50 carbon atoms, more preferably from 1 to about 30 carbon atoms, more preferably from 3 to about 18 carbon atoms, more preferably from 4 to about 8 carbon atoms. Each $R''^1$ and $R''^2$ is preferably independently an alkyl group. Examples of $R''^1$ and $R''^2$ include independently t-butyl, isobutyl, amyl, isooctyl, decyl, dodecyl, eicosyl, 2-pentenyl, dodecenyl, phenyl, naphthyl, alkylphenyl, alkylnaphthyl, phenylalkyl, naphthylalkyl, alkylphenylalkyl, alkylnaphthylalkyl groups, and the like.

In Formula VI, preferably each $R''^3$, $R''^4$ and $R''^5$ is independently a hydrogen or hydrocarbyl group of from 1 to about 50 carbon atoms. More preferably, each $R''^3$, $R''^4$ and $R''^5$ is independently a hydrogen; alkyl group of from 1 to about 22 carbon atoms; cycloalkyl groups of from about 4 to about 22 carbon atoms; or aromatic, alkyl-substituted aromatic or aromatic-substituted alkyl group of from about 4 to about 34 carbon atoms.

In Formula VI, $R''^6$ is preferably an alkyl group of from 1 to about 22 carbon atoms; a cycloalkyl group of from about 4 to about 22 carbon atoms; or an aromatic, alkyl-substituted aromatic or aromatic-substituted alkyl group of from about 4 to about 34 carbon atoms.

In a particularly preferred embodiment, $R''^1$ and $R''^2$ of Formula VI is independently an alkyl group of from about 3 to about 18 carbon atoms; $X''^1$ and $X''^2$ are oxygen; $X''^3$ and $X''^4$ are sulfur; $R''^3$, $R''^4$ and $R''^5$ independently are hydrogen or methyl; and n'' is 1.

The phosphorus-containing esters (D-5) may be prepared by reaction of a phosphorus acid, such as a dithiophosphoric acid, as described above, and an alpha, beta unsaturated carboxylic acid or ester, such as acrylic acid or ester or methacrylic acid or ester. If the carboxylic acid is used, the ester may then be formed by subsequent reaction with an alcohol.

Additional Components

The lubricating compositions of the present invention may additionally contain other components such as friction modifiers,-copper corrosion inhibitors, etc.

Component (E)

The lubricating compositions of the present invention may additionally contain a friction modifier selected from the group consisting of a fatty phosphite, a fatty acid amide, a fatty amine, a borated fatty amine, a borated fatty epoxide, a glycerol ester and a borated glycerol ester.

The fatty phosphites useful as friction modifiers in the present invention are generally dialkyl hydrogen phosphites having alkyl groups having from about 8 to about 24, preferably about 12 to about 22, more preferably about 16 to about 20 carbon atoms in each alkyl group. A particularly useful fatty phosphite is a dioleyl hydrogen phosphite.

The fatty acid amides which are useful in the present invention are generally amides derived from fatty acids having from about 4 to about 28, preferably about 12 to about 22, preferably about 16 to about 20 carbon atoms. A particularly useful fatty acid amide is oleyl amide, linoleyl amide, stearyl amide or tall oil amide, with oleyl amide being preferred.

The fatty amines useful as friction modifiers are generally primary, secondary or tertiary amines having alkyl, alkoxyl or polyoxyalkene groups. Preferably the fatty amine is any of the fatty amines described under Component D-2 above, more preferably the amine is an Ethomeen as described above.

The borated fatty amines are prepared by reacting a borating agent (described above) with a fatty amine (described above). The borated fatty amines are prepared by reacting the amine with the borating agent at about 50° C. to about 300° C., preferably about 100° C. to about 250° C., and at a ratio of 3:1 to 1:3 equivalents of amine to equivalents of borating agent.

The borated fatty epoxide useful as friction modifiers in the present invention are generally the reaction product of a boric acid or boron-trioxide with at least one epoxide. The epoxide is generally an aliphatic epoxide having at least 8 carbon atoms, more preferably from about 10 to about 20, more preferably 12 to about 20. Examples of useful aliphatic epoxides include heptyl oxide, octyl oxide, stearyl oxide, oleyl oxide and the like. Mixtures of epoxides may also be used, for instance commercial mixtures of epoxides having from 14 to about 16 carbon atoms and 14 to about 18 carbon atoms.

The borated fatty epoxides are generally known and are disclosed in Canadian Patent 1,188,704 issued to Davis. This patent is incorporated by reference for its disclosure of borated fatty epoxides and methods for preparing the same.

The glycerol esters useful in the present invention are glycerol esters of fatty acids, such as fatty acids having from about 8 to about 22 carbon atoms, preferably about 12 to about 20. Examples of fatty acids useful in preparing the esters are oleic, stearic, linoleic acids and the like. The esters may be mono-, di-, or triesters of fatty esters. Glycerol mono-oleate and glycerol tallowate are known commercial materials. It is generally recognized that esters of glycerol are actually mixtures of mono- and diesters. A particularly useful ester is a mixture of mono- and diester containing at least 40% of the monoester of glycerol. Preferably, the mixtures of mono- and diesters of glycerol contain from about 40 to about 60% by weight of the monoester. For example, commercial glycerol monoleate contains a mixture of from about 45% to about 55% by weight monoester and from 55% to about 45% of the monoester. Glycerol monoleate in its commercially available mixtures are preferred.

The borated glycerol esters useful in the present invention are prepared by reacting the fatty acid ester of glycerol with boric acid and removal of water. Preferably, the boric acid and the fatty acid ester are reacted such that each boron will react with from 1.5 to about 2.5 hydroxy groups present in the mixture.

The reaction may be carried out at a temperature in the range of from about 60° C. to about 135° C. in the absence or presence of any suitable organic solvent such as methanol, benzene, xylene, toluene, or the like.

U.S. Pat. No. 4,792,410, issued to Schwind et al, described friction modifiers and that disclosure is hereby incorporated by reference.

Component F

Lubricating compositions of the present invention may additionally contain an amide, imide, imidazolene, or salt, or mixture thereof which is the reaction product of an alkenyl succinic anhydride or acid and a compound having at least one NH group. These compounds are useful in giving the lubricating formulations, particularly concentrates, stability by preventing phase separation.

The alkenyl succinic anhydride has a substituent which has a number average molecular weight in the range from about 500 to about 5000, preferably about 750 to about 2500, more preferably about 750 to about 1500, more preferably about 1000. The substituent is generally derived from the polymer of an olefin having from 2 to about 20, more preferably 2 to about 8, more preferably 2 to 4, more preferably 4, carbon atoms. Generally the substituent is derived from a polybutene.

A compound having at least one NH group can be a monoamine or a polyamine compound. Preferably, the amine contains at least one primary amino group and more preferably the amine is a polyalkylene polyamine containing at least 2 NH groups. The polyamines are generally polyalkylene polyamines including hydroxy polyalkylene polyamines, branched polyalkylene polyamines and the like. Examples of useful polyamines include ethylene polyamines. A particularly useful polyamine is a tetraethylenepentamine.

The alkenyl succinic acid or anhydride and compounds having at least one NH group (amine) and the product of the reaction are described and disclosed in U.S. Pat. Nos. 4,234,435, 3,172,892 and 3,219,666, the disclosure of which is hereby incorporated by reference.

Example F-1

A polybutenyl succinic anhydride (1000 parts; 1.78 equivalents), where the polybutenyl group has a number average molecular weight of about 950, and 700 parts of a 100 neutral oil are added to a vessel and heated to 95° C. To the mixture is added 54 parts (1.29 equivalents) of a commercial polyamine mixture having 33% nitrogen and an equivalent weight of 42, while maintaining the temperature at 95° C. to 120° C. The reaction temperature is then raised to 150° C. The reaction is blown with nitrogen gas for one hour at about 150° C. The reaction is filtered through diatomaceous earth. The filtrate is the product.

Component G

The lubricating compositions of the present invention may additionally contain a copper corrosion inhibitor. The copper corrosion inhibitor acts to control deleterious effects of active sulfur on copper components within the manual transmission and gear assemblies. The copper corrosion inhibitor controls any darkening and/or corrosion of these copper parts.

It has generally been found that derivatives of dimercaptothiadiazole may be used as copper corrosion inhibitors.

In a preferred embodiment the copper corrosion inhibitor is the reaction product of a dispersant and a dimercaptothiadiazole.

The dispersant may be generally characterized as a carboxylic dispersant which includes succinimide dispersants, ester type dispersants and the like. Succinimide dispersants are generally the reaction of a polyamine with an alkenyl succinic anhydride or acid. Ester type dispersants are the reaction product of an alkenyl succinic anhydride or acid with a polyol compound. The reaction product may then be further treated with an amine such as a polyamine.

Generally the reaction occurs between the dispersant and the dimercaptothiadiazole by heating and mixing the two at a temperature above 100° C.

U.S. Pat. Nos. 4,140,643 and 4,136,043 both issued to Davis describe the compounds which are the reaction of a dispersant with a dimercaptothiadiazole. The disclosure relating to the dispersants, the dimercaptothiadiazole, the method for reacting the two and the products obtained are disclosed in those references, which are hereby incorporated by reference.

In another embodiment, the copper corrosion inhibitor is the reaction product of a phenol with an aldehyde and a dimercaptothiadiazole.

The phenol is preferably an alkyl phenol wherein the alkyl group contains at least about 6, preferably 6 to 24, more preferably 6 to 12, more preferably 7, carbon atoms.

The aldehyde is preferably an aldehyde containing from 1 to about 7 carbon atoms or an aldehyde synthon such as formaldehyde. Preferably, the aldehyde is formaldehyde or paraformaldehyde.

Generally, the aidehyde, phenol and dimercaptothiadiazole are reacted by mixing the above reagents at a temperature up to 150° C., preferably about 50 to about 130° C. Generally, the reagents are reacted in molar ratios of about 0.5 to 2 moles of phenol and aldehyde per mole of dimercaptothiadiazole. Preferably, the three agents are reacted in equal molar amounts.

In another embodiment, the copper corrosion inhibitor is a bis(hydrocarbyldithio)thiadiazole. Preferably each hydrocarbyl group is independently an alkyl, aryl or aralkyl group, having from 6 to about 24 carbon atoms. Preferably each hydrocarbyl is independently t-octyl, nonyl, decyl, dodecyl or ethylhexyl. Preferably the copper corrosion inhibitor is bis-2,5-tert-octyldithio-1,3,4-thiadiazole or mixtures of such compounds with 2-tert-octyl-thio-5-mercapto-1,3,4-thiadiazole. These materials are available commercially under the trade name of Amoco 150 which is available from Amoco Chemical Company. These dithiothiadiazole compounds are disclosed as Component (B) in PCT Publication WO 88/03551 which is hereby incorporated by reference for its disclosure of dithiothiadiazole compounds. Amount of Components The lubricating compositions of the present invention generally contain from about 0.1 to about 4% by weight, preferably 0.5 to about 3, preferably about 1% by weight of the borated overbased metal salt of the organic acid (Component B). The lubricating composition further contains from about 0.5 to about 8, preferably 0.75 to about 6, preferably about 3.5% by weight of the polysulfide-containing composition (Component C). The lubricating compositions of the present invention generally contain from about 0.1 to about 4%, preferably 0.5 to about 3%, preferably about 1.3% of the phosphorus-containing composition (Component D). The friction modifier (Component E) useful in the present invention is optionally present at about 0.1 to about 5, preferably 0.25 to about 4, preferably 0.5 to about 3.5% by weight. The dispersant (Component F) is optionally present at about 0.1 to about 3%, preferably 0.5% to 1.5%, preferably about 1% by weight. The copper corrosion inhibitor (Component G) is present at about 0.1% to about 3%, preferably 0.5% to about 1.5%, more preferably 0.8% by weight.

The concentrate compositions of the present invention contain from about 0.1% to about 99% by weight of a composition comprising Components (B), (C) and (D).

Example I

A concentrate is prepared by mixing 9 parts of Example B-2, 61 parts of Example C-1, 23.5 parts of Example D-6, and 7 parts of a 100 neutral mineral oil.

Example II

A SAE 90 weight lubricant formulation is prepared by mixing 92.9 parts of SAE 90 weight oil from Sipco Petroleum and 0.6 parts of Example B-2, 3.5 parts of Example C-1, 1.3 parts of Example D-6, 0.6 parts of Example F-1, 0.3 parts of triphenyl phosphite, 0.3 parts of glycerol monooleate, 0.1 parts of a silicon foam inhibitor, and 0.4 parts of the reaction product of dimercaptothiadiazole with a polybutenyl succinic anhydride (561 equivalent weight, with the polybutenyl group having a number average molecular weight of about 1000) partially esterified with pentaerythritol and then treated with polyethylene amines. The reaction product is prepared by the reaction of the reactants at a ratio of (1 carbonyl group:1.8 hydroxyl groups:0.3 nitrogen atoms).

Example III

An SAE 90 weight lubricant formulation is prepared by the same procedure of Example II except that 1.3 parts of tricresyl phosphate is used in place of 1.3 parts of Example D-6, and 0.3 parts of dibutyl hydrogen phosphite is used in place of 0.3 parts of triphenyl phosphite.

Example IV

An SAE 90 weight lubricant formulation is prepared by the same procedure of Example II except that 0.7 parts of a Primene 81 salt of dimethylamyl phosphoric acid, and 0.6 parts of dibutyl hydrogen phosphite are used in place of 1.3 parts of Example D-6 and 0.3 parts of triphenyl phosphite, respectively.

Example V

An SAE 90 weight lubricant formulation is prepared by the same procedure of Example II except that 0.6 parts of Example B-1 is used in place of 0.6 parts of Example B-2.

Example VI

An SAE 90 weight lubricant formulation is prepared by the same procedure of Example III except that 0.6 parts of Example B-1 is used in place of 0.6 parts of Example B-2.

Example VII

An SAE 90 weight lubricant formulation is prepared by the same procedure of Example IV except that 0.6 parts of Example B-1 is used in place of 0.6 parts of of Example B-2.

As stated previously, the lubricating formulations of the present invention provide effective friction properties required by a manual transmission as well as extreme pressure properties required by the final drive gear assemblies.

To illustrate the effective lubrication of manual transmissions, Example II was tested in the ZF-Herion-Synchonizer test. The test generally measures the torque generated during meshing of the synchronizer. The test procedure is generally known and is described in ZF-Herion-Systemtechnik GMBH, Operation and Service Manual for Test Bed Ref. 22249 for Testing of Lubrication Oils for Synchromesh Components.

The extreme pressure and antiwear properties of Example II were measured in ASTM L37 and ASTM L42 tests. The L37 test operates under low speed, high torque conditions and evaluates the load carrying ability, wear stability and corrosion characteristics of gear lubricants. The L42 test is the industry standard to evaluate the antiscore performance of extreme pressure additives in gear lubricants under high speed, shock load conditions.

Example II passed the L37, L42 and ZF-Herion-Synchronizer tests at 100,000 cycles.

As can be seen by the performance in the above-described test, the lubricating compositions of the present invention provide the necessary frictional and extreme pressure properties required of a universal fluid to effectively lubricate a manual transmission and a gear assembly.

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

I claim:

1. A lubricating composition, comprising:

(A) a major amount of an oil of lubricating viscosity;

(B) at least one berated overbased Group I or II metal salt of an organic acid;

(C) at least one polysulfide-containing organic composition; and (D) at least one phosphorus-containing composition other than a zinc dithiophosphate selected from the group consisting of (D-2) an ammonium salt of a compound represented by the formula

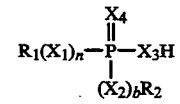

(I)

wherein each $X_1$, $X_2$, $X_3$ and $X_4$ is independently oxygen or sulfur; each a and b is independently 0 or 1; and wherein each $R_1$ and $R_2$ is independently hydrogen, hydrocarbyl, or a substituent represented by the formula

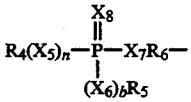

(III)

one of $R_4$ and $R_5$ and one of $R_1$ and $R_2$ is hydrocarbyl, $R_4$ is an alkylene or alkylidene group, each a and b is independently 0 or 1, and each $X_5$, $X_6$, $X_7$ and $X_8$ is independently oxygen or sulfur;

(D-3) a phosphite represented by the following formulae:

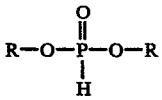

(III)

or $$(RO)_3P \qquad \text{(IV)}$$

wherein each R is independently hydrogen or a hydrocarbyl group provided at least one R is hydrocarbyl;

(D-6) mixtures of two or more thereof.

2. The composition of claim 1, wherein the organic acid of (B) is a sulfonic acid, a carboxylic acid, a phenol, a phosphorus-containing acid or mixtures of two or more thereof.

3. The composition of claim 1, wherein the organic acid of (B) is a sulfonic acid.

4. The composition of claim 1 wherein the organic acid of (B) is a salicylic acid.

5. The composition of claim 1, wherein (B) is a borated overbased Group I metal salt of an organic acid.

6. The composition of claim 1, wherein (B) is a borated overbased sodium salt of an organic acid.

7. The composition of claim 1, wherein (B) is a borated overbased Group II metal salt of an organic acid.

8. The composition of claim 1, wherein (B) is a borated overbased magnesium salt of an organic acid.

9. The composition of claim 1, wherein the polysulfide-containing organic composition (C) is the reaction product of a sulfurizing agent and an olefin represented by the formula $$R^{*1}R^{*2}C{=}CR^{*3}R^{*4} \qquad \text{(VII)}$$

wherein each $R^{*1}$, $R^{*2}$, $R^{*3}$ and $R^{*4}$ is independently hydrogen, hydrocarbyl, $-COOR^{*5}$, $-CON(R^{*5})_2$, $-C(O)O^-N^+(R^{*5})_4$, $(-COO)_zM$, $-CN$, or $-Y-R^{*5}$, wherein each $R^{*5}$ is hydrocarbyl;

M is a metal cation;

Y is oxygen or divalent sulfur; and z is equal to the valence of the metal cation.

10. The composition of claim 9, wherein each $R^{*1}$, $R^{*2}$, $R^{*3}$ and $R^{*4}$ is independently hydrogen or hydrocarbyl.

11. The composition of claim 9, wherein the polysulfide is a di-, tri-, or tetrasulfide.

12. The composition of claim 9, wherein each $R^{*1}$ and $R^{*2}$ is independently an alkyl group having from 1 to about 8 carbon atoms and $R^{*3}$ and $R^{*4}$ are hydrogen.

13. The composition of claim 1, wherein each $R_1$ and $R_2$ is independently a hydrocarbyl group containing from about 1 to about 30 carbon atoms.

14. The composition of claim 1, wherein $R_1$ and $R_2$ are each independently butyl, hexyl, heptyl, octyl, oleyl or cresyl groups.

15. The composition of claim 1, wherein $X_1$ and $X_2$ are oxygen and $X_3$ and $X_4$ are sulfur.

16. The composition of claim 1, wherein each $R_1$ and $R_2$ is independently hydrogen or the substituent represented by the formula

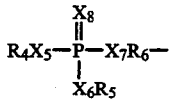

(II)

17. The composition of claim 1, wherein (D) is an ammonium salt (D-2) and a and b are each 1.

18. The composition of claim 17, wherein the ammonium salt is formed from an hydroxyamine, an ether amine or an alkyl amine having from 1 to about 24 carbon atoms.

19. The composition of claim 18, wherein the alkyl amine is a tertiary-alkyl primary amine.

20. The composition of claim 1, wherein the phosphorus-containing composition (D) is the phosphite (D-3).

21. The composition of claim 1, wherein (B) is present in an amount from about 0.1 to about 4% by weight;

(C) is present in an amount from about 0.5 to about 8% by weight; and (D) is present in an amount from about 0.1 to about 4% by weight.

22. The composition of claim 1, further comprising:

(E) from 0 to about 5% by weight of at least one friction modifier selected from the group consisting of a fatty phosphite, a fatty acid amide, a fatty amine, a borated fatty amine, a borated fatty epoxide, a glycerol ester or borated glycerol ester, and a mixture of two or more thereof;

(F) 0 to about 5% by weight of at least one amide, imide, imidazoline, or salt; or mixture thereof which is the reaction product of an alkenyl succinic anhydride or acid and a compound having at least one NH group; and (G) from 0 to about 3% by weight of a copper corrosion inhibitor; provided at least one of (E), (F) or (G) is present.

23. A lubricating composition, comprising:

(A) a major amount of an oil of lubricating viscosity, (B) from about 0.1% to about 4% by weight of a borated overbased Group I or II metal salt of an organic acid, (C) from about 0.5% to about 8% by weight of a polysulfide-containing composition, (D) from about 0.1% to about 4% by weight of a phosphoruscontaining composition other than a zinc dithiophosphate, wherein the phosphorus-containing composition is selected from (D-2) an ammonium salt of a compound represented by the formula

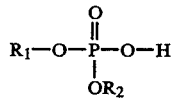

(VIII)

wherein each $R_1$ and $R_2$ is independently hydrogen, hydrocarbyl, or a substituent represented by the formula

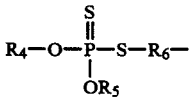

(IX)

wherein each $R_4$ and $R_5$ is independently hydrogen or hydrocarbyl, provided at least one of $R_4$ and $R_5$ and one of $R_1$ and $R_2$ is hydrocarbyl, wherein $R_6$ is an alkylene or alkylidene group;

(D-3) a phosphite represented by the following formulae:

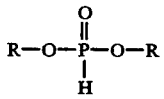

(III)

or $(RO)_3—P$ (IV)

wherein each R is independently hydrogen or a hydrocarbyl group provided at least one R is hydrocarbyl; and (D-6) mixtures of two or more thereof.

24. The composition of claim 23, wherein (B) the borated overbased salt (B) is a borated overbased magnesium sulfonate.

25. The composition of claim 23, wherein (D) is the ammonium salt (D-2) and is derived from an alkyl amine having from about 1 to about 24 carbon atoms.

26. The composition of claim 25, wherein the alkyl amine has from about 10 to about 16 carbon atoms.

27. The composition of claim 23, wherein (D) is the phosphite (D-3), wherein R is a propyl, butyl, pentyl or oleyl group.

28. The composition of claim 23, wherein the polysulfide is a sulfurized olefin, wherein the olefin is propene, butene, or oligomers thereof.

29. The composition of claim 23, further comprising:

(E) from 0 to about 5% by weight of at least one friction modifier selected from the group consisting of a fatty phosphite, a fatty acid amide, a fatty amine, a borated fatty amine, a borated fatty epoxide, a glycerol ester or borated glycerol ester, and a mixture of two or more thereof;

(F) 0 to about 5% by weight of an amide, imide, imidazoline, or salt; or mixture thereof which is the reaction product of an alkenyl succinic anhydride or acid and a compound having at least one NH group; and (G) from 0 to about 3% by weight of a copper corrosion inhibitor; provided at least one of (E), (F) or (G) is present.

30. A lubricating composition, comprising:

(A) a major amount of an oil of lubricating viscosity;

(B) at least one borated overbased alkali metal or alkaline earth metal salt of an organic acid;

(C) at least one polysulfide-containing organic composition; and (D) at least one phosphorus-containing composition prepared by the process comprising forming an acidic intermediate by reacting at a temperature of from about 25° C., to about 150° C., a hydroxy-substituted triester of a phosphorodithioic acid having the formula

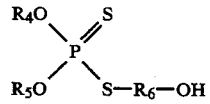

(XII)

wherein each $R_4$ and $R_5$ is independently a hydrocarbyl group and $R_6$ is an alkylene and arylene group with phosphorus pentoxide, the molar ratio of the hydroxy-substituted triester to phosphorus pentoxide being within the range of from about 2:1 to about 5:1, and neutralizing at a temperature of from about 0° to 200° C., at least about 50% of the acidic mixture with an amine selected from the group consisting of a hydrocarbyl and a hydroxysubstituted hydrocarbyl amine having from about 4 to about 30 carbon atoms.

31. The composition of claim 30, wherein the amine is a tertiary-alkyl primary amine.

32. The composition of claim 30, further comprising:

(E) from 0 to about 5% by weight of at least one friction modifier selected from the group consisting of a fatty phosphite, a fatty acid amide, a fatty amine, a borated fatty amine, a borated fatty epoxide, a glycerol ester or borated glycerol ester, and a mixture of two or more thereof.

(F) 0 to about 5% by weight of an amide, imide, imidazoline, salt or mixtures thereof of the reaction product of an alkenyl succinic anhydride or acid and a compound having at least one NH group; and (G) from 0 to about 3% by weight of a copper corrosion inhibitor; provided at least one of (E), (F) or (G) is present.

33. A method of lubricating, comprising:

contacting components of a manual transmission or automotive gear assembly with the composition of claim 1.

34. A method of lubricating, comprising:.

contacting components of a manual transmission or automotive gear assembly with the composition of claim 23.

35. A concentrate composition, comprising (A) substantially inert diluent, and from about 0.1% to about 99% by weight of a composition comprising:

(B) at least one borated overbased Group I or II metal salt of an organic acid;

(C) at least one polysulfide-containing organic composition; and (D) at least one phosphorus-containing composition other than a zinc dithiophosphate is selected from the group consisting of (D-b 2) an ammonium salt of a compound represented by the formula

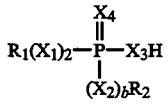

(I)

wherein each $X_1$, $X_2$, $X_3$ and $X_4$ is independently oxygen or sulfur; each a and b is independently 0 or 1; and wherein each $R_1$ and $R_2$ is independently hydrogen, hydrocarbyl, or a substituent represented by the formula

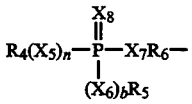

(II)

wherein each $R_4$ and $R_5$ is independently hydrogen or hydrocarbyl, provided at least one of $R_4$ and $R_5$ and one of $R_1$ and $R_2$ is hydrocarbyl, $R_6$ is an alkylene or alkylidene group, each a and b is independently 0 or 1, and each $X_5$, $X_6$, $X_7$ and $X_8$ is independently oxygen or sulfur;

(D-3) a phosphite represented by the following formulae:

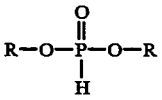

(III)

or $(RO)_3P$ (IV)

wherein each R is independently hydrogen or a hydrocarbyl group provided at least one R is hydrocarbyl;

(D-6) mixtures of two or more thereof.

36. The composition of claim 1, wherein $X_5$ and $X_6$ are oxygen and wherein $X_7$ and $X_8$ are sulfur.

37. The composition of claim 1, wherein each $R_4$ and $R_5$ is independently an alkyl group having from about 2 to about 30 carbon atoms or aryl group having from about 6 to about 30 carbon atoms.

38. The composition of claim 20, wherein each R is independently a hydrocarbyl group having from about 1 to about 18 carbon atoms.

39. A lubricating composition, comprising:

(A) a major mount of an oil of lubricating viscosity; (B) at least one borated overbased Group I or II metal salt of an organic acid; (C) at least one polysulfide-containing organic composition; and (D) at least one phosphorus-containing composition other than a zinc dithiophosphate, wherein the phosphorus-containing composition comprising at least one mixture of (a) an ammonium salt of a compound represented by the formula

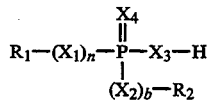

wherein each $X_1$, $X_2$, $X_3$ and $X_4$ is independently oxygen or sulfur; each a and b is independently 0 or 1; and wherein each $R_1$ and $R_2$ is independently hydrogen, hydrocarbyl, or a substituent represented by the formula

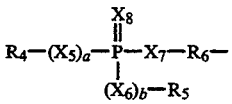

wherein each $R_4$ and $R_5$ is independently hydrogen or hydrocarbyl, provided at least one of $R_4$ and $R_5$ and at least one of $R_1$ and $R_2$ is hydrocarbyl, $R_6$ is an alkylene or alkylidene group, each a and b is independently 0 or 1, and each $X_5$, $X_6$, $X_7$ and $X_8$ is independently oxygen or sulfur; and (b) a phosphite represented by the following formulae:

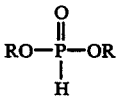

or $(RO)_3P$ wherein each R is independently hydrogen or a hydrocarbyl group provided at least one R is hydrocarbyl.

40. The composition of claim 39, wherein the organic acid of (B) is a sulfonic acid, a carboxylic acid, a phenol, a phosphorus-containing acid or mixtures of two or more thereof.

41. The composition of claim 39, wherein the organic acid of (B) is a sulfonic acid or a carboxylic acid.

42. The composition of claim 39, wherein (B) is a borated overbased Group I or Group II metal salt of an organic acid.

43. The composition of claim 39, wherein (B) is a borated overbased sodium or magnesium salt of an organic acid.

44. The composition of claim 39, wherein the polysulfide-containing organic composition (C) is the reaction product of a sulfurizing agent and an olefin represented by the formula $R^{*1}R^{*2}C{=}CR^{*3}R^{*4}$; wherein each $R^{*1}$, $R^{*2}$, $R^{*3}$ and $R^{*4}$ is independently hydrogen, hydrocarbyl, $-COOR^{*5}$, $-CON(R^{*5})_2$, $-C(O)O^-N^+(R^{*5})_4$, $(-COO)_zM$, $-CN$, or $-Y-R^{*5}$, wherein each $R^{*5}$ is hydrocarbyl; M is a metal cation; Y is oxygen or divalent sulfur; and z is equal to the valence of the metal cation.

45. The composition of claim 44, wherein each $R^{*1}$, $R^{*2}$, $R^{*3}$ and $R^{*4}$ is independently hydrogen or hydrocarbyl.

46. The composition of claim 44, wherein the polysulfide contains greater than 70% trisulfide.

47. The composition of claim 44, wherein each $R^{*1}$, and $R^{*2}$ is independently an alkyl group having from 1 to about 8 carbon atoms and $R^{*3}$ and $R^{*4}$ are hydrogen.

48. The composition of claim 39, wherein a and b are 1, and wherein each $R_1$ and $R_2$ is independently a hydrocarbyl group containing from about 1 to about 30 carbon atoms.

49. The composition of claim 39, wherein each $R_1$ and $R_2$ is independently an alkyl group having from about 1 to about 12 carbon atoms or an aryl group having from 6 to about 18 carbon atoms.

50. The composition of claim 39, wherein each $R_1$ and $R_2$ are a 2-ethylhexyl group.

51. The composition of claim 39, wherein each $X_1$, $X_2$, $X_3$ and $X_4$ is oxygen.

52. The composition of claim 39, wherein each $R_1$ and $R_2$ is independently hydrogen or the substituent represented by the formula

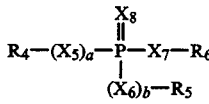

53. The composition of claim 39, wherein each $R_4$ and $R_5$ is independently an alkyl group having from about 2 to about 30 carbon atoms or aryl group having from about 6 to about 30 carbon atoms, and $R_6$ is an alkylene group having from 1 to about 24 carbon atoms.

54. The composition of claim 39, wherein the ammonium salt is formed from at least one amine.

55. The composition of claim 39, wherein the ammonium salt is derived from a tertiary-alkyl primary amine.

56. The composition of claim 39, wherein each R is independently a hydrocarbyl group having from about 1 to about 18 carbon atoms.

57. The composition of claim 39, wherein the mixture further comprises at least one monothiophosphate.

58. A lubricating composition, comprising: (A) a major amount of an oil of lubricating viscosity, (B) from about 0.1 to about 4% by weight of a borated overbased Group I or II metal salt of an organic acid, (C) from about 0.5 to about 8% by weight of a polysulfide-containing composition, (D) from about 0.1 to about 4% by weight of a phosphorus-containing composition other than a zinc dithiophosphate comprising, wherein the phosphorus-containing composition comprises at least one mixture of (a) an ammonium salt of a compound represented by the formula

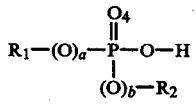

wherein each a and b is independently 0 or 1; and each $R_1$ and $R_2$ is independently hydrogen, hydrocarbyl, or a substituent represented by the formula

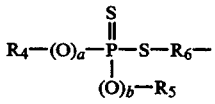

wherein each $R_4$ and $R_5$ is independently hydrogen or hydrocarbyl, provided at least one of $R_4$ and $R_5$ and at least one of $R_1$ and $R_2$ is hydrocarbyl, $R_6$ is an alkylene or alkylidene group, each a and b is independently 0 or 1; and (b) a phosphite represented by the following formulae:

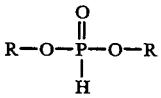

or $(RO)_3P$ wherein each R is independently hydrogen or a hydrocarbyl group having from one to about 24 carbon atoms provided at least one R is hydrocarbyl.

59. The composition of claim 58, wherein (B) the borated overbased salt (B) is a borated overbased sodium or magnesium sulfonate.

60. The composition of claim 58, wherein the mixture further comprises at least one monothiophosphate.

61. The composition of claim 60, wherein each $R_1$ and $R_2$ is independently hydrogen or an alkyl group having from 1 to about 18 carbon atoms.

62. The composition of claim 61, wherein each $R_1$ and $R_2$ is independently hydrogen or the substituent represented by the formula

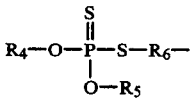

wherein each $R_4$ and $R_5$ is independently an alkyl group having from about 2 to about 12 carbon atoms and $R_6$ is an alkylene group having from about 2 to about 6 carbon atoms.

63. The composition of claim 60, wherein the ammonium salt is derived from an alkyl amine having from about 1 to about 24 carbon atoms.

64. The composition of claim 60, wherein the ammonium salt is derived from a tertiary aliphatic primary mine.

65. The composition of claim 58, wherein the polysulfide contains greater than 70% trisulfide.

66. The composition of claim 58, wherein the polysulfide is a sulfurized olefin, wherein the olefin is propene, butene, or oligomers thereof.

67. A concentrate composition, comprising (A) substantially inert diluent, and from about 0.1% to about 99% by weight of a composition comprising: (B) at least one borated overbased Group I or II metal salt of an organic acid; (C) at least one polysulfide-containing organic composition; and (D) at least one phosphorus-containing composition other than a zinc dithiophosphate, wherein the phosphorus-containing composition comprising at least one mixture of (a) an ammonium salt of a compound represented by the formula

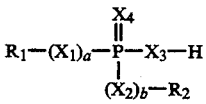

wherein each $X_1$, $X_2$, $X_3$ and $X_4$ is independently oxygen or sulfur; each a and b is independently 0 or 1; and wherein each $R_1$ and $R_2$ is independently hydrogen, hydrocarbyl, or a substituent represented by the formula

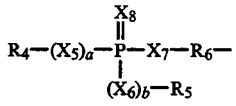

wherein each $R_4$ and $R_5$ is independently hydrogen or hydrocarbyl, provided at least one of $R_4$ and $R_5$ and at least one of $R_1$ and $R_2$ is hydrocarbyl, $R_6$ is an alkylene or alkylidene group, each a and b is independently 0 or 1, and each $X_5$, $X_6$, $X_7$ and $X_8$ is independently oxygen or sulfur; and (b) a phosphite represented by the following formulae:

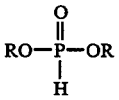

or $(RO)_3P$ wherein each R is independently hydrogen or a hydrocarbyl group provided at least one R is hydrocarbyl.

* * * * *

UNITED STATES PATENT AND TRADEMARK OFFICE

CERTIFICATE OF CORRECTION

PATENT NO. : 5,403,501

DATED : April 4, 1995

INVENTOR(S) : James J. Schwind

It is certified that error appears in the above-indentified patent and that said Letters Patent is hereby corrected as shown below:

In the Claims:

In column 29, line 4, please change the word "berated" to --borated--.

In column 29, lines 14-18, please change the formula from

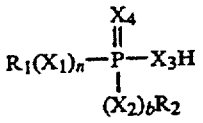

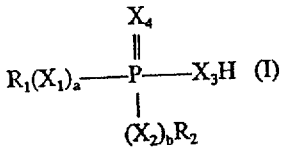

In column 29, lines 26-29, please change the formula from

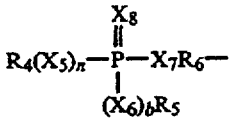

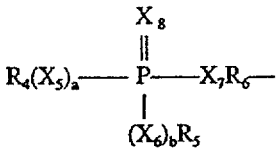

In column 29, line 27, please change "(III)" to --(II)--.

UNITED STATES PATENT AND TRADEMARK OFFICE

CERTIFICATE OF CORRECTION

PATENT NO. : 5,403,501

DATED : April 4, 1995

INVENTOR(S) : James J. Schwind

It is certified that error appears in the above-indentified patent and that said Letters Patent is hereby corrected as shown below:

In column 29, please delete lines 31-35 and add the following:

--wherein each $R_4$ and $R_5$ is independently hydrogen or hydrocarbyl, provided at least one of $R_4$ and $R_5$ and one of $R_1$ and $R_2$ is hydrocarbyl, $R_6$ is an alkylene or alkylidene group, each a and b is independently 0 or 1, and each $X_5$, $X_6$, $X_7$ and $X_8$ is independently oxygen or sulfur;--.

Signed and Sealed this

Twelfth Day of October, 1999

*Attest:*

Q. TODD DICKINSON

*Attesting Officer*

*Acting Commissioner of Patents and Trademarks*